US012331534B2

(12) United States Patent
Morijiri et al.

(10) Patent No.: US 12,331,534 B2
(45) Date of Patent: Jun. 17, 2025

(54) BINDING MACHINE

(71) Applicant: MAX CO., LTD., Tokyo (JP)

(72) Inventors: Takeshi Morijiri, Tokyo (JP); Takashi Akiyama, Tokyo (JP); Takanori Ban, Tokyo (JP)

(73) Assignee: Max Co., Ltd., Tokyo (JP)

( * ) Notice: Subject to any disclaimer, the term of this patent is extended or adjusted under 35 U.S.C. 154(b) by 76 days.

(21) Appl. No.: 17/749,812

(22) Filed: May 20, 2022

(65) Prior Publication Data

US 2022/0282506 A1 Sep. 8, 2022

Related U.S. Application Data

(62) Division of application No. 16/001,324, filed on Jun. 6, 2018, now Pat. No. 11,365,552.

(30) Foreign Application Priority Data

Jun. 7, 2017 (JP) ..... 2017-113038
Jan. 19, 2018 (JP) ..... 2018-007382

(51) Int. Cl.
*E04G 21/12* (2006.01)
*B21F 15/04* (2006.01)
*B65B 13/28* (2006.01)

(52) U.S. Cl.
CPC ..... *E04G 21/123* (2013.01); *B21F 15/04* (2013.01); *B65B 13/285* (2013.01)

(58) Field of Classification Search
CPC ..... E04G 21/123; B21F 15/04; B65B 13/285; B65B 13/28; B65B 13/187; B65B 13/06
USPC ..... 140/93.6
See application file for complete search history.

(56) References Cited

U.S. PATENT DOCUMENTS 3,273,605 A * 9/1966 Ferrara, Jr. ..... B21F 15/04 140/149
4,354,535 A 10/1982 Powell et al.
5,323,816 A 6/1994 Hoyaukin
5,505,504 A 4/1996 Sato et al.
5,682,927 A 11/1997 Takahashi et al.
5,937,916 A 8/1999 Hoyaukin
(Continued)

FOREIGN PATENT DOCUMENTS

CN 1075687 A 9/1993
CN 1193371 A 9/1998
(Continued)

OTHER PUBLICATIONS

Japanese Office Action dated Oct. 26, 2021, issued in the corresponding Japanese Patent Application No. 2018-007382. (5 pages).
(Continued)

*Primary Examiner* — Adam J Eiseman
*Assistant Examiner* — Fred C Hammers
(74) *Attorney, Agent, or Firm* — Banner & Witcoff, Ltd.

(57) ABSTRACT

A binding machine includes a first main body, a second main body and a bridge part. The first main body houses a binding part which twists a wire and a driving part which drives the binding part. The second main body is provided with a handle part including an operation trigger. The bridge part connects the first main body and the second main body to each other.

10 Claims, 14 Drawing Sheets

(56) References Cited

U.S. PATENT DOCUMENTS

| | | | | |
|---|---|---|---|---|
| 5,944,064 | A * | 8/1999 | Saito | E04G 21/122 140/57 |
| 5,947,166 | A | 9/1999 | Doyle et al. | |
| 6,588,109 | B2 * | 7/2003 | Wilson | A01D 34/416 30/276 |
| 7,290,570 | B1 | 11/2007 | Spikes | |
| 8,881,408 | B2 | 11/2014 | Martinsson et al. | |
| 9,457,921 | B2 | 10/2016 | Barnes et al. | |
| 9,591,809 | B2 | 3/2017 | Gieske et al. | |
| 10,323,425 | B2 | 6/2019 | Itagaki et al. | |
| 2006/0042713 | A1 | 3/2006 | Cheng | |
| 2006/0157139 | A1 | 7/2006 | Hoyaukin | |
| 2008/0110354 | A1 | 5/2008 | Itagaki et al. | |
| 2009/0090428 | A1 | 4/2009 | Kasahara et al. | |
| 2010/0224278 | A1 | 9/2010 | Kusakari et al. | |
| 2015/0176295 | A1 | 6/2015 | Kasahara et al. | |
| 2018/0332766 | A1 | 11/2018 | Ackerman et al. | |

FOREIGN PATENT DOCUMENTS

| | | | |
|---|---|---|---|
| CN | 204645665 | U | 9/2015 |
| EP | 0731238 | A1 | 11/1996 |
| JP | 63-191719 | A | 8/1988 |
| JP | S64-9115 | A | 1/1989 |
| JP | 7-290177 | A | 11/1995 |
| JP | H07290177 | * | 11/1995 |
| JP | 2006-200196 | A | 8/2006 |
| JP | 2006-520865 | A | 9/2006 |
| JP | 2007-008562 | A | 1/2007 |
| JP | 4760439 | B2 | 8/2011 |
| JP | 2012-036722 | A | 2/2012 |
| WO | 87/01313 | A1 | 3/1987 |
| WO | 92/06260 | A1 | 4/1992 |
| WO | 96/25330 | A1 | 8/1996 |

OTHER PUBLICATIONS

The Office Action mailed Mar. 16, 2021 in corresponding CN Patent Application No. 2018-10579864.1 (10 pages).

Translation, JP 7-290177 A; Nov. 1995.

The extended European search report mailed Dec. 19, 2018 in corresponding EP Patent Application No. 18176443.2 (8 pages).

Chinese Office Action dated Oct. 31, 2022, issued by the The State Intellectual Property Office of People's Republic of China in the corresponding Chinese Patent Application No. 201810579864.1, with English translation. (15 pages).

Japanese Office Action dated Oct. 4, 2022, issued in corresponding Japanese Patent Application No. 2021-212371, and a English translation thereof. (12 pages).

* cited by examiner

BINDING MACHINE

CROSS-REFERENCE TO RELATED APPLICATIONS

This application is a divisional application of U.S. Ser. No. 16/001,324 filed on Jun. 6, 2018, which claims priority from Japanese Patent Application No. 2017-113038 filed on Jun. 7, 2017 and Japanese Patent Application No. 2018-007382 filed on Jan. 19, 2018, all of which are incorporated herein in their entirety by reference is claimed to each.

TECHNICAL FIELD

The present invention relates to a binding machine that binds objects to be bound such as a reinforcing bar with a wire.

BACKGROUND

In the related art, proposed herein is a binding machine which is referred to as a reinforcing bar binding machine binds a plurality of reinforcing bars by winding wires around peripheries of the reinforcing bars and by twisting the wires (for example, refer to JP-B-4760439).

Further, proposed herein is another binding machine in which a handle part is provided at a rear end of a reinforcing bar binding machine, and a guide part for curling a wire in a periphery of a reinforcing bar and a twisting part for twisting the wire are disposed at a position separated from the handle part (for example, refer to JP-A-2006-520865 and WO96/25330).

SUMMARY

For example, there is a case where reinforcing bars in a deep side are desired to be bound by using a binding machine in a work site where the reinforcing bars arranged in lattice shapes are formed of two layers. However, a binding machine disclosed in JP-B-4760439 is formed to have a short length from a handle part to a guide part, such that the guide part and a twisting part can hardly reach the reinforcing bars in the deep side when another reinforcing bar existing in a front side becomes obstructive. Further, a binding machine disclosed in JP-A-2006-520865 is formed to have a long length from the handle part to the guide part. However, a binding machine main body is too big, such that the binding machine main body can hardly pass through a lattice shaped by another reinforcing bar existing in front of the binding machine. Additionally, in a binding machine disclosed in WO96/25330, since a front handle part becomes obstructive, the binding machine can hardly pass through the lattice shaped by another reinforcing bar existing in front of the binding machine. Therefore, all of the above-mentioned binding machines have significant difficulty in binding the reinforcing bars in the deep side.

In consideration of the drawbacks described above, the present invention has been made in an effort to provide a binding machine that is capable of binding an object to be bound, even when the object to be bound exists in a deep side of a narrow space.

According to one aspect of the disclosure, a binding machine includes a first main body, a second main body and a bridge part. The first main body houses a binding part which twists a wire and a driving part which drives the binding part. The second main body is provided with a handle part including an operation trigger. The bridge part connects the first main body and the second main body to each other.

DETAILED DESCRIPTION

A reinforcing bar binding machine of the present invention will be described more fully hereinafter with reference to the accompanying drawings, in which embodiments of the invention are shown.

Figure 1:
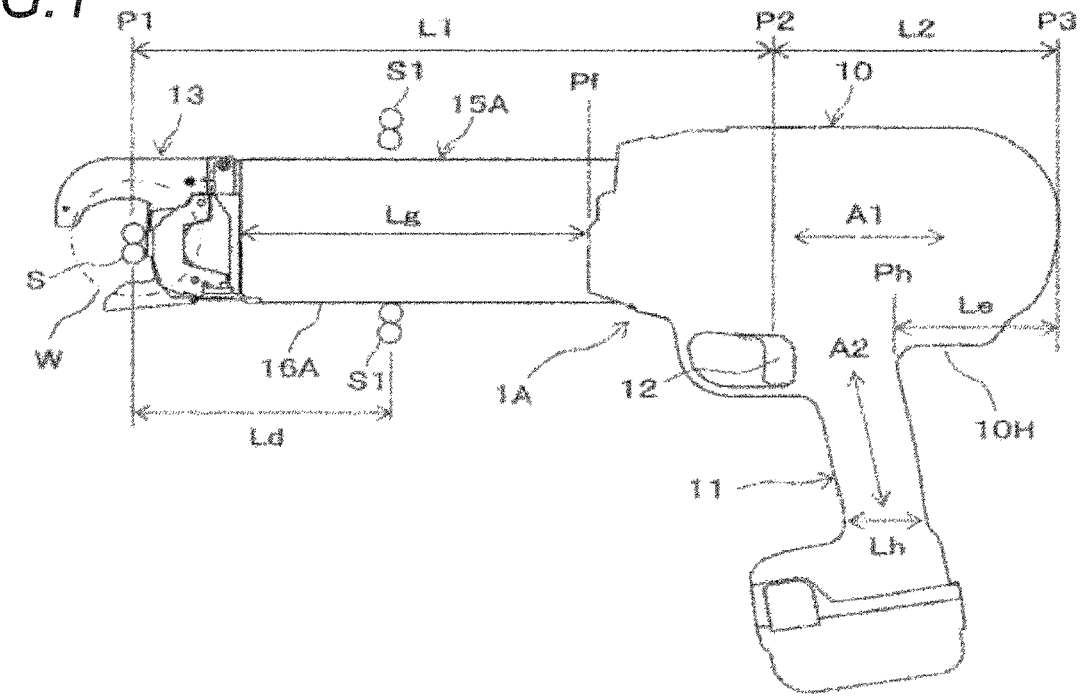
FIG. 1 is a diagram illustrating an example of an overall configuration of a reinforcing bar binding machine according to a first embodiment, when viewed from one side.
Figure 2:
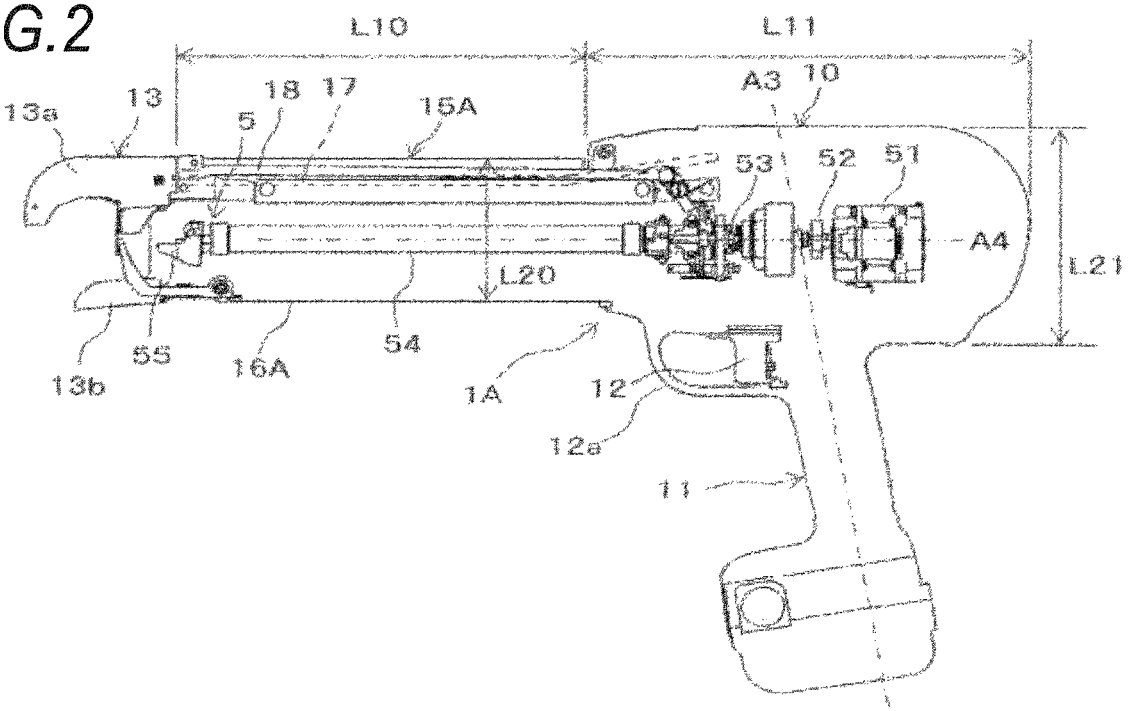
FIG. 2 is a diagram illustrating an example of an internal configuration of the reinforcing bar binding machine according to the first embodiment, when viewed from one side.
Figure 3:
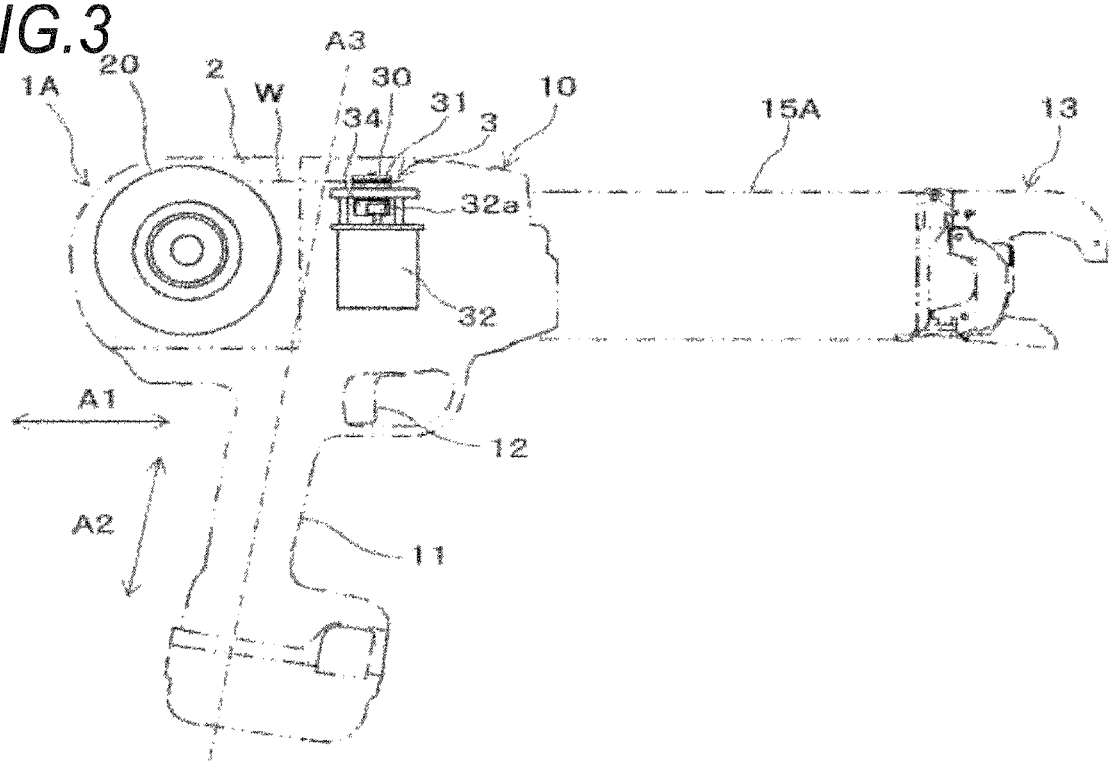
FIG. 3 is a diagram illustrating an example of the internal configuration of the reinforcing bar binding machine according to the first embodiment, when viewed from the other side.
Figure 4:
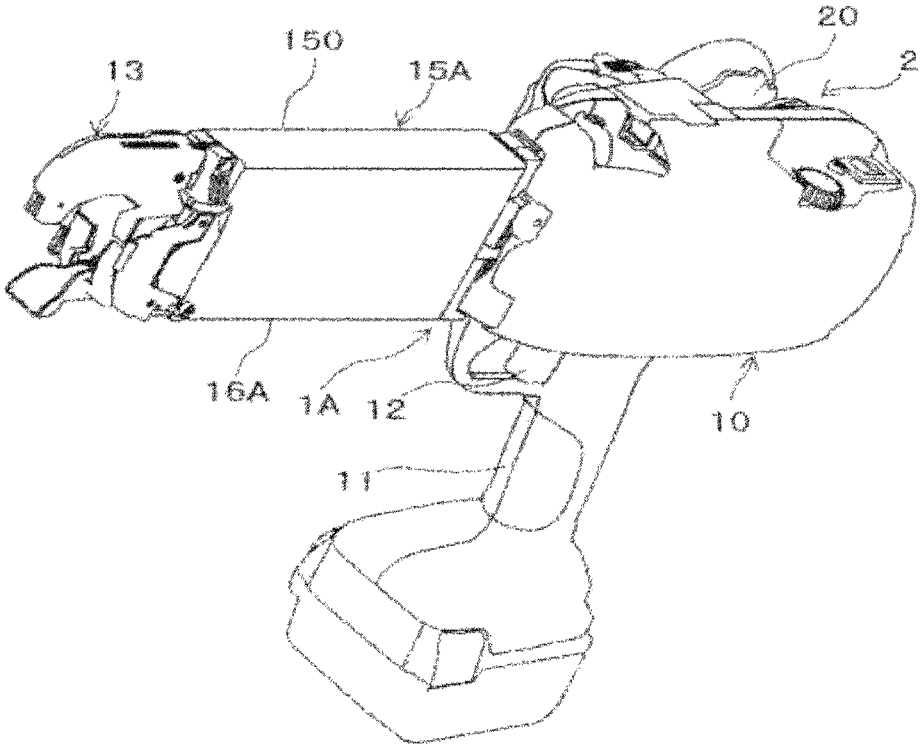
FIG. 4 is a perspective view illustrating an example of the overall configuration of the reinforcing bar binding machine according to the first embodiment.
Figure 5:
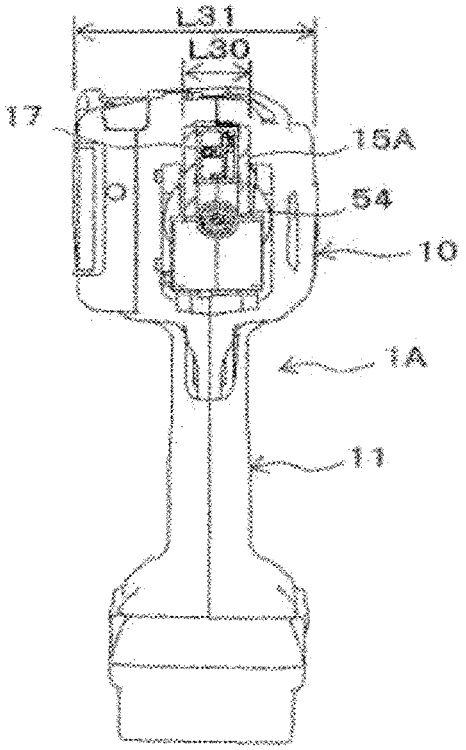
FIG. 5 is a front view illustrating the example of the internal configuration of the reinforcing bar binding machine according to the first embodiment.

Configuration Examples of Reinforcing Bar Binding Machine According to First Embodiment FIG. 1 is a diagram illustrating an example of an overall configuration of a reinforcing bar binding machine according to a first embodiment, when viewed from one side; FIG. 2 is a diagram illustrating an example of an internal configuration of the reinforcing bar binding machine according to the first embodiment, when viewed from one side; and FIG. 3 is a diagram illustrating an example of the internal configuration of the reinforcing bar binding machine according to the first embodiment, when viewed from the other side. Further, FIG. 4 is a perspective view illustrating an example of the overall configuration of the reinforcing bar binding machine according to the first embodiment; and FIG. 5 is a front view illustrating the example of the internal configuration of the reinforcing bar binding machine according to the first embodiment.

A reinforcing bar binding machine 1A according to a first embodiment is provided with a binding machine main body 10 having a shape that extends in one direction as a first direction; and a handle part 11 which is provided with the binding machine main body 10 and has a shape extending in the other direction as a second direction. Here, a direction shown by an arrow A1 in FIG. 1 is the first direction, that is, one direction and an extending direction of the binding machine main body 10. A direction shown by an arrow A2 is the second direction, that is, the other direction and an extending direction of the handle part 11.

The handle part 11 is provided with an operation trigger 12 as one example of operation parts on one side (a front end side of the binding machine main body 10) in the extending direction A1 of the binding machine main body 10. Further, the reinforcing bar binding machine 1A is provided with a guide part 13 that guides a wire W to one side of the binding machine main body 10 in the extending direction A1 of the binding machine main body 10. Specifically, the guide part 13 curls the wire W in a periphery of a reinforcing bar S.

A worker gripping the handle part 11 can bind the reinforcing bar S with the wire W by operating the operation trigger 12 by moving the guide part 13 to a position where the reinforcing bar binding machine 1A can bind the reinforcing bar S. Further, the position in the guide part 13 where the reinforcing bar S can be bound by the wire W is hereinafter referred as an action position P1.

The handle part 11 is provided at the other end side (a rear end side) from a center in the extending direction A1 of the binding machine main body 10, and extends from only one position of the binding machine main body 10 to the other direction at a position separated from the other end side. A length L1 from a position P2 of the operation trigger 12 in the extending direction A1 of the binding machine main body 10 to the action position P1 of the guide part 13 is longer than a length L2 from the position P2 of the operation trigger 12 to the other end position P3 of the binding machine main body 10. Specifically, the length L1 is set to be 1.5 times longer than the length L2, but it is desirable that the length L1 is set to be 2 times longer than the length L2. Further, a length Le from a portion Ph from which the handle part 11 extends (a root portion of the handle part 11 with respect to the binding machine main body 10, and the other side of the binding machine main body 10 in the extending direction A1) to a virtual line (tangential line segment passing through the end position P3 in FIG. 1) that is orthogonal to the extending direction A1 at the other end position P3 in the extending direction A1 is formed to be ½ times (one half) or more desirably 1 times longer than a width Lh of the handle part in the extending direction A1. Accordingly, a back portion of the hand between a thumb and a forefinger when the worker grips the handle part 11 comes into contact with a contacting side surface part 10H, which corresponds to a portion of the length Le, that is disposed at a lower side of the end part of the binding machine main body 10. That is, the binding machine main body 10 has a shape in which the other end side in the extending direction A1 protrudes from the portion Ph from which the handle part 11 extends in the extending direction A1.

Figure 6:
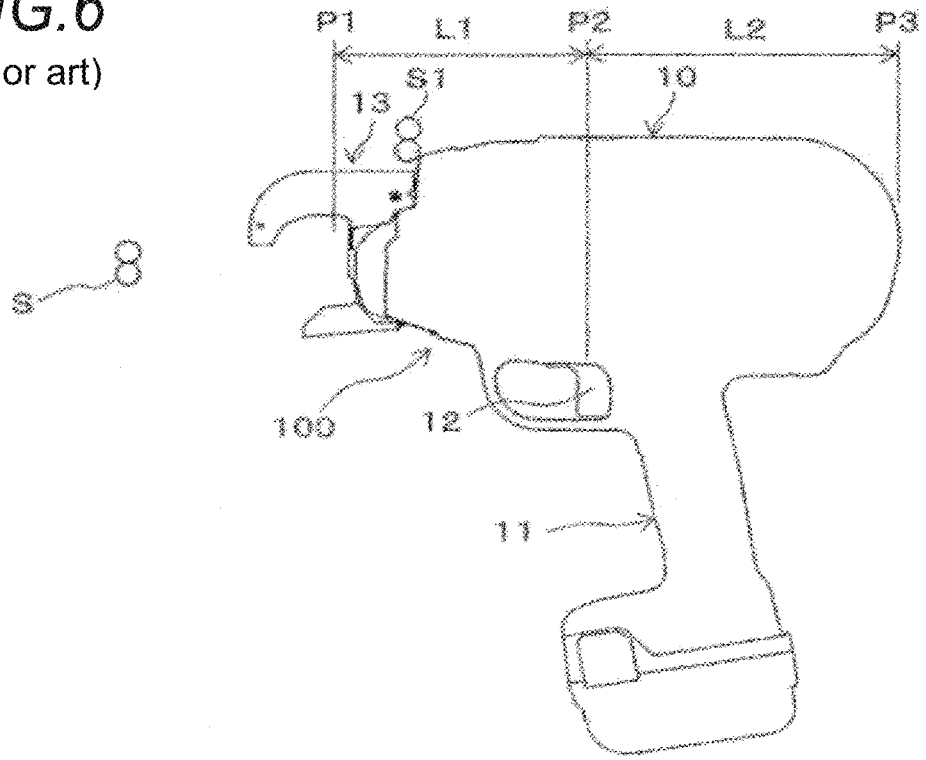
FIG.6 (prior art)
FIG. 6 is a diagram illustrating a configuration of a reinforcing bar binding machine of the related art which is illustrated to show a drawback thereof, when viewed from one side.

FIG. 6 is a diagram illustrating a configuration of a reinforcing bar binding machine of the related art which is illustrated to show a drawback thereof, when viewed from one side. A reinforcing bar binding machine 100 of the related art is formed such that a length L1 from a position P2 of an operation trigger 12 to an action position P1 of a guide part 13 is equal to or shorter than a length L2 from the position P2 of the operation trigger 12 to the other end position P3 of a binding machine main body 10.

Therefore, for example, when reinforcing bars arranged in a lattice shape are two-layer structure, even though a reinforcing bar in a deep side is desired to be bound, another reinforcing bar in a front side becomes obstructive, such that the guide part 13 can hardly reach the reinforcing bar in the deep side, and thus consequently it is not possible to bind the reinforcing bar therein.

On the other hand, the reinforcing bar binding machine 1A according to the first embodiment is formed such that the length L1 from the position P2 of the operation trigger 12 to the action position P1 of the guide part 13 is longer in comparison with the reinforcing bar binding machine 100 of the related art, such that the guide part can reach the reinforcing bar existing in the deep side and can bind the reinforcing bar therein, even though another reinforcing bar existing in front of the worker is obstructive. Further, since the required length L is different depending on a working environment, the length L may be appropriately set in consideration of the working environment.

Further, as described above, the handle part 11 is provided at the other end side from the center in the extending direction A1 of the binding machine main body 10, and extends from only one position of the binding machine main body 10 to the other direction at the position separated from the other end side. Accordingly, even though the length L1 from the operation trigger 12 to the guide part 13 extends, heavy objects such as a twisting motor 51 (a torsion motor 51), and the like are disposed at a portion ranging from the portion Ph from which the handle part 11 extends to the other end position P3 of the binding machine main body 10, such that it is advantageously possible not only to appropriately maintain a weight balance between one end side and the other end side in the extending direction A1 of the binding machine main body 10, but also to prevent operability from deteriorating.

Additionally, the length Le is formed to be ½ times (one half) or more desirably 1 times longer than the width Lh, such that the back portion of the hand between the thumb and the forefinger when the worker grips the handle part 11 comes into contact with the contacting side surface part 10H. Accordingly, it is advantageously possible not only to grip the handle part 11, but also to firmly hold the binding machine main body 10 by a portion of the contacting side surface part 10H.

Next, the reinforcing bar binding machine 1A according to the first embodiment will be described in detail with reference to the accompanying drawings from FIGS. 1 to 5. The reinforcing bar binding machine 1A is provided with an housing part 2 in which a wire reel 20, around which one or a plurality of wires W is wound, is housed to be rotatable, and a wire feeding part 3 from which the wire W wound in the wire reel 20 is fed. Further, the reinforcing bar binding machine 1A is provided with a binding part 5 in which the wire W wound around the reinforcing bar S is twisted by the guide part 13.

The housing part 2 is provided with a recessed shape in which all or part of the wire reel 20, which a heavy object, can be disposed at the other end side in the extending direction A1 of the binding machine main body 10, and a shaft part (not shown) which supports the wire reel 20 to be rotatable is provided in the housing part 2. Further, the housing part 2 supports the wire reel 20 at a position in which all or part of the wire reel 20 protrudes toward the other end side in the extending direction A1 of the binding machine main body 10 with respect to an axis A3 of the handle part 11 in the extending direction A2. The reinforcing bar binding machine 1A is provided with a braking part (not shown) for braking the wire reel 20.

The wire feeding part 3 is provided with a feeding gear 30 as a pair of feeding members. The feeding gear 30 is a spur gear having teeth on an outer peripheral surface in which a groove part 31 for accommodating the wire W in a circumferential direction is formed on the outer peripheral surface.

In the wire feeding part 3, a pair of feeding gears 30 is disposed with a feeding path of the wire W sandwiched therebetween, and outer peripheral surfaces are opposite to each other. Further, the pair of feeding gears 30 is relatively energized in an approaching direction by an energizing means such as a spring (not shown). Accordingly, in the wire feeding part 3, the teeth of the pair of feeding gears 30 are engaged with each other, and driving force is transmitted from one side of the feeding gear 30 to the other side of the feeding gear 30.

The wire feeding part 3 is provided with a feeding motor 32 for driving the feeding gear 30. The feeding motor 32 is connected to one side of the feeding gear 30 via a gear 32*a* and a gear 34. When the feeding motor 32 rotates, the driving force of the feeding motor 32 is transmitted to one side of the feeding gear 30 via the gear 32*a* and the gear 34. When one side of the feeding gear 30 rotates, the other side of the feeding gear 30 that is engaged with one side of the feeding gear 30 also rotates.

The wire feeding part 3 is provided between the housing part 2 and the guide part 13 at one side in the extending direction A1 of the binding machine main body 10 with respect to the axis A3 of the handle part 11. Further, the feeding motor 32 is provided near the axis A3 of the handle part 11.

The wire feeding part 3 feeds the wire W by rotating the feeding gear 30 by using the feeding motor 32 in a state where the wire W is placed in the groove part 31 of the pair of feeding gears 30 and is sandwiched between the pair of feeding gears 30. The wire feeding part 3 feeds the wire W to the guide part 13.

The guide part 13 curls the wire W in the periphery of the reinforcing bar by controlling an advancing direction of the wire W fed by the wire feeding part 3. The guide part 13 is provided with a first guide part 13*a* for curling the wire (for adding a curling tendency), and a second guide part 13*b* which is provided to be opposite to the first guide part 13*a* and receives the wire W having the curling shape formed by the first guide part 13*a*, and then guides the wire W to a position where the wire W can be locked by a twisting hook (twisting part) 55 which will be described later. The reinforcing bar binding machine 1A is provided with a cutting part (not shown) which is provided near the guide part 13 and cuts the wire W.

The binding part 5 is provided with the twisting motor 51, a gear 52, a threaded shaft part 53, an advancing and retreating cylindrical part 54 as one example of transmission parts, and a twisting hook 55 as one example of twisting parts. The twisting motor 51 is one example of motors, and is provided at the other end side in the extending direction A1 of the binding machine main body 10 with respect to the axis A3 of the handle part 11. Further, the twisting motor 51 is provided in parallel with the housing part 2 in the embodiment.

The threaded shaft part 53 is rotatably supported with respect to the binding machine main body 10, and is rotated by driving force of the twisting motor 51 that is transmitted via the gear 52. A screw is formed on an outer peripheral surface of the threaded shaft part 53, and a screw is formed on an inner peripheral surface of the advancing and retreating cylindrical part 54, such that the screw formed on the outer peripheral surface thereof is screwed with the screw formed on the inner peripheral surface thereof (that is, the screw formed on the outer peripheral surface thereof and the screw formed on the inner peripheral surface thereof are screwed with each other).

The advancing and retreating cylindrical part 54 moves back and forth by rotating the threaded shaft part 53 that is rotated by rotation of the twisting motor 51 in a state where rotation of the advancing and retreating cylindrical part 54 is restricted. Further, the threaded shaft part 53 and the advancing and retreating cylindrical part 54 are engaged with each other so as to be integrally rotatable, such that the threaded shaft part 53 is rotated by the twisting motor 51, thereby rotating the advancing and retreating cylindrical part 54.

The twisting hook 55 is a pair of claw-shaped members that is mounted at a tip of the advancing and retreating cylindrical part 54. The twisting hook 55 is formed to be opened and closed according to advancing and retreating movement of the advancing/retreading cylindrical part 54 based upon a well-known configuration.

The reinforcing bar binding machine 1A is provided with a connection part 15A having a long shape which is provided between the binding machine main body 10 and the guide part 13 and houses the advancing and retreating cylindrical part 54. The connection part 15A is provided between one end Pf in the extending direction A1 of the binding machine main body 10 and the guide part 13, and extends in the extending direction A1. The connection part 15A is formed in a rectangular shape in a cross-sectional view in the embodiment, but is not intended to be limited thereto. In the connection part 15A, a length Lg in the extending direction A1 of the binding machine main body 10 is longer than a length Ld from an introduced obstacle such as another reinforcing bar S1 disposed at a side (a front side) of the binding machine main body 10 with respect to the reinforcing bar S which is an object to be bound to the reinforcing bar S, and further a width of the connection part 15A in the extending direction A2 is at least approximately same as or smaller than a width of an outside of the guide part 13. Accordingly, the guide part 13 can moves forward passing through another reinforcing bar S1 and can be guided to the reinforcing bar S.

The guide part 13 is provided at an end part in one direction of the connection part 15A, that is, provided at a tip side of the connection part 15A, and the twisting hook 55 of the binding part 5 is provided at an end part in one direction of the connection part 15A, that is, provided at an inside of a tip side of the connection part 15A. The advancing and retreating cylindrical part 54 extends in the extending direction A1 of the binding machine main body 10 at the inside of the connection part 15A to operate the twisting hook 55.

The connection part 15A is formed of a metallic material. Meanwhile, an exterior part 150 may be formed of the metallic material, and an interior part for supporting a component such as a guiding path 17 which will be described later, and the like may be formed of a resin material. The connection part 15A is provided with a flat-shaped support part 16A at least one side surface of the exterior part 150 and, in the embodiment, at a side surface facing a lower side when the handle part 11 is directed downward in a vertical direction, the flat support part 16A is provided at the aforementioned portion, such that it is advantageously possible to support the binding machine main body 10 and the connection part 15A by the reinforcing bar S1 existing in the front side when binding the reinforcing bar S. Further, when the connection part 15A is, for example, an ellipse shape in a cross-sectional view, a curved surface part facing the lower side when the handle part 11 is directed downward in the vertical direction may be used as the support part 16A (the curved surface part at the lower side may be processed as a flat shape). In the embodiment, the connection part 15A is formed as a member that is independent of the binding machine main body 10. Alternatively, the connection part 15A may be integrally formed with the binding machine main body 10.

The connection part 15A houses the guiding path 17 through which the wire W fed by the wire feeding part 3 is guided to the guide part 13. A driving force transmission member 18 which transmits driving force to a blade part of a cutting part (not shown), is provided in the connection part 15A to be movable in the extending direction A1 of the binding machine main body 10. That is, the guiding path 17, the driving force transmission member 18, and the advancing and retreating cylindrical part 54 in the connection part 15A respectively extend in one direction in the extending direction A1 with the extension of the connection part 15A.

Action Effect of Reinforcing Bar Binding Machine of First Embodiment

Next, Operation in which the reinforcing bar S is bound by the wire W will be described. The action position P1 of the guide part 13 is aligned to the reinforcing bar S and the operation trigger 12 is operated, such that the feeding motor 32 is operated to feed the wire W in a predetermined amount by the wire feeding part 3. The wire W fed by the wire feeding part 3 is guided to the first guide part 13*a* through the guiding path 17, and is wound around the reinforcing bar S by the guide part 13. The number of winding the wire W around the periphery of the reinforcing bar S is set depending on a feeding amount of the wire W.

Next, the twisting motor 51 is normally rotated, and the rotation of the twisting motor 51 is transmitted to the threaded shaft part 53 via the gear 52. At this time, the threaded shaft part 53 rotates, however, since the rotation of the advancing and retreating cylindrical part 54 is restricted, the advancing and retreating cylindrical part 54 is sent forward by action of a threadedly engaged screw. As described above, the advancing and retreating cylindrical part 54 is sent forward, such that the twisting hook 55 advances to a position where the twisting hook comes into contact with the wire W. The twisting hook 55 interlocks with the advance of the advancing and retreating cylindrical part 54, thereby being operated in a closing direction, after which the twisting hook grips a portion of the wire W wound around the periphery of the reinforcing bar S.

The advancing and retreating cylindrical part 54 is released from rotation restriction thereof at a predetermined advanced position, and rotates together with the threaded shaft part 53. The twisting hook 55 gripping the wire W is rotated, such that the wire W is twisted. The blade part of the cutting part (not shown) is operated to cut the wire W while the advancing and retreating cylindrical part 54 is advancing.

When the aforementioned twisting operation is finished, the twisting motor 51 is reversed, and the threaded shaft part 53 is rotated in a reverse direction. Accordingly, the advancing and retreating cylindrical part 54 and the twisting hook 55 are moved backward, and the twisting hook 55 is opened to be separate from the wire W. The twisting motor 51 is reversed until the advancing and retreating cylindrical part 54 and the twisting hook 55 are moved to a stand-by position. When the advancing and retreating cylindrical part 54 and the twisting hook 55 are moved to the stand-by position, the twisting motor 51 is stopped and a series of operations are completed.

Next, action effect of the connection part 15A will be described. The reinforcing bar binding machine 1A is provided with the connection part 15A. Specifically, the length L1 from the position P2 of the operation trigger 12 in the extending direction A1 of the binding machine main body 10 to the action position P1 of the guide part 13 is longer than the length L2 from the position P2 of the operation trigger 12 to the other end position P3 of the binding machine main body 10.

More specifically, as shown in FIG. 2, a length in an axial direction A4 of the advancing and retreating cylindrical part 54 of the connection part 15A, that is, a length L10 in a long-length direction of the connection part 15A (an overall length of the connection part 15A) is set to be longer than ⅓ (one third) of a length L11 (an overall length of the binding machine main body 10) of the extending direction A1 of the binding machine main body 10 in the axial direction A4 of the advancing and retreating cylindrical part 54.

The binding machine main body 10 houses the feeding gear 30, and the feeding motor 32 which drives the gears 32*a*, 34 and the feeding gear 30. The wire feeding part 3 is formed by the feeding gear 30, the gear 32*a*, 34 and the feeding motor 32. Further, the binding machine main body 10 houses all of the twisting motor 51, the gear 52, and the threaded shaft part 53, and houses a part of the advancing and retreating cylindrical part 54.

The advancing and retreating cylindrical part 54 is connected to the threaded shaft part 53, and extends in an axial direction of the threaded shaft part 53. The extending direction A1 of the binding machine main body 10 is almost parallel with the extending direction A4 of the advancing and retreating cylindrical part 54. As shown in FIG. 3, the housing part 2 is provided at the other end side of the binding machine main body 10, and the wire reel 20 supported by the housing part 2 is disposed not to protrude from the binding machine main body 10 to an outer side in the radial direction. Therefore, in consideration of a size of the binding machine main body 10, the wire reel 20 can be disposed as described above, and sizes of the aforementioned respective components are set to be appropriately housed in the binding machine main body 10. For example, an overall length L11 of the binding machine main body 10 may vary depending on a position of the housing part 2 and the respective components to be housed therein, and is set to be in a range from about 15 cm to about 30 cm (an overall height and an overall width of the binding machine main body 10 will be described later). In the embodiment, the overall length L11 of the binding machine main body 10 is about 20 cm. Further, an overall length L10 of the connection part 15A is set to be longer than ⅓ (one third) of the overall length L11 of the binding machine main body 10. Accordingly, when the overall length L11 of the binding machine main body 10 is in a range from about 15 cm to about 30 cm, the overall length L10 of the connection part 15A is set to be longer than from about 5 cm to about 10 cm.

Additionally, as shown in FIG. 2, in the connection part 15A, a length in a direction in which the first guide part 13*a* and the second guide part 13*b* are opposite to each other, that is, a length L20 in a short-length direction of the connection part (an overall height of the connection part 15A) is set to be equal to or shorter than a length L21 in the same direction of the binding machine main body 10 (an overall height of the binding machine main body 10).

More specifically, the overall height L21 of the binding machine main body 10 is set to be from about 8 cm to about 13 cm, and the overall height L21 thereof in the embodiment is about 10 cm. Accordingly, since the overall height L20 of the connection part 15A is set to be equal to or shorter than the overall height L21 of the binding machine main body 10, the overall height L20 of the connection part 15A becomes equal to or shorter than from about 8 cm to about 13 cm when the overall height L21 of the binding machine main body 10 is from about 8 cm to about 13 cm.

Further, in the connection part 15A, a length L30 in a direction that is orthogonal to a long-length direction of the connection part 15A and a short-length direction thereof (an overall width of the connection part) is set to be equal to or shorter than ½(one half) of a length L31 in a direction that is orthogonal to a long-length direction of the binding machine body 10 and a short-length direction thereof (an overall width of the binding machine main body 10).

In the reinforcing bar binding machine 1A, a portion around which the wire feeding part 3 is provided has the widest width in the binding machine main body 10, and the overall width L31 of the binding machine main body 10 is set to be from about 8 cm to about 14 cm. The overall width L31 of the binding machine main body 10 in the embodiment is set to be about 15 cm. Accordingly, since the overall width L30 of the connection part 15A is set to be equal to or shorter than ½ (one half) of the overall width L31 of the binding machine main body 10, the overall width L30 of the connection part 15A becomes equal to or shorter than from about 4 cm to about 7 cm when the overall width L31 of the binding machine main body 10 is set to be from about 8 cm to about 14 cm.

When the reinforcing bar S, which is the object to be bound, and another reinforcing bar S1 are formed to be a double-layer structure, the length Ld from another reinforcing bar S1 to the reinforcing bar S is set to be from about 10 cm to about 30 cm or longer. Further, a gap at which the reinforcing bars S1 having a lattice shape are arranged in parallel is set to be from about 15 cm to about 25 cm. However, arrangement of the reinforcing bars S1 having the lattice shape is not limited to a square, but may be a rectangle, and further a long-side thereof may be about 15 cm or a short-side thereof may be about 7 cm.

Here, the connection part 15A is the rectangular shape in the cross-sectional view in which the overall width thereof is shorter than the overall height thereof, and the overall length, the overall height and the overall width are respectively set in consideration of the aforementioned ratios with respect to the binding machine main body 10. Further, in the connection part 15A, the overall width is shorter than the overall height. In other words, the connection part 15A may have an ellipse shape in a cross-sectional view in which the overall height is longer than the overall width.

As described above, another reinforcing bar S1 is arranged in a lattice shape between the reinforcing bar S, which is the object to be bound, and the binding machine main body 10, and even when the binding machine main body 10 cannot be placed between the lattices shaped by another reinforcing bar S1, the connection part 15A can be passed through and inserted into the lattices shaped by another reinforcing bar S1, after which the guide part 13 can reach a position where the action position P1 of the guide part 13 is aligned to the reinforcing bar S.

Figure 7A:
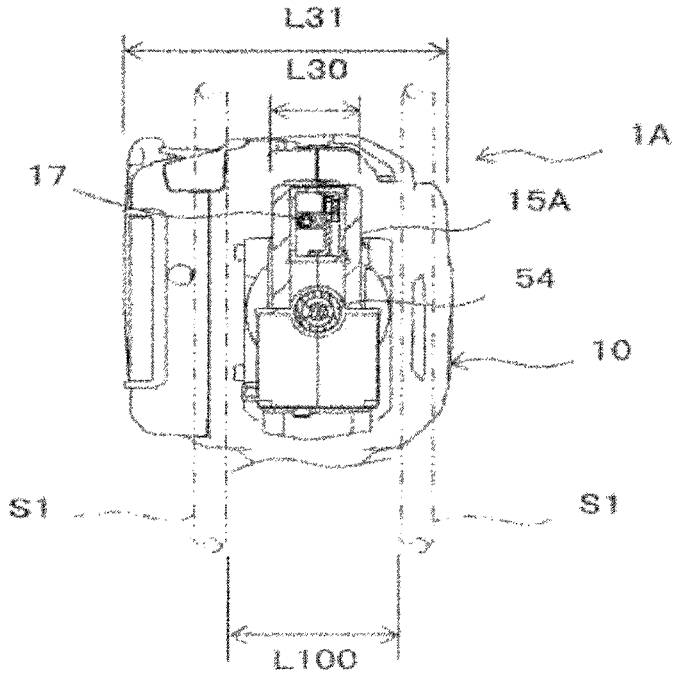
FIGS. 7A and 7B are diagrams illustrating an example of action effect of the reinforcing bar binding machine according to the first embodiment.
Figure 7B:
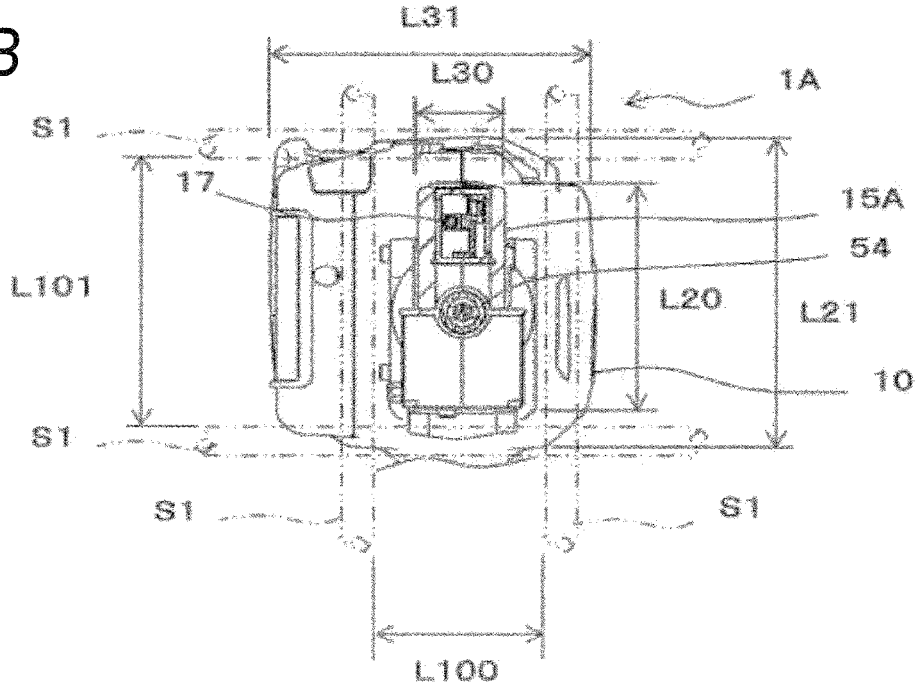

FIGS. 7A and 7B are diagrams illustrating an example of action effect of the reinforcing bar binding machine according to the first embodiment. As shown in FIG. 7A, when the reinforcing bars S1 are arranged in parallel, and a gap L100 between neighboring reinforcing bars S1 is smaller than the overall width L31 of the binding machine main body 10, the binding machine main body 10 cannot be placed between the reinforcing bars S1 arranged in parallel. On the other hand, when the overall width L30 of the connection part 15A is smaller than the gap L100 in which the reinforcing bars S1 are arranged in parallel, the connection part 15A can be placed between the reinforcing bars S1 arranged in parallel. Further, the connection part 15A is rotatable around an axis of the advancing and retreating cylindrical part 54.

Further, as shown in FIG. 7B, when the reinforcing bars S1 are arranged in the lattice shape, and an gap L101 at a long-side of the lattice is smaller than the overall height L21 of the binding machine main body 10, and an gap L100 at a short-side of the lattice is smaller than the overall width L31 of the binding machine main body 10, the binding machine main body 10 cannot be placed between the reinforcing bars S1 having the lattice shape. On the other hand, when the overall height L20 of the connection part 15A is smaller than the gap L101 at the long-side of the lattice, and the overall width L30 of the connection part 15A is smaller than the gap L100 at the short-side of the lattice, the connection part 15A can be placed between the reinforcing bars S1 having the lattice shape. Further, the connection part 15A is rotatable around the axis of the advancing and retreating cylindrical part 54.

Accordingly, as shown in FIG. 7A, even when the reinforcing bars S1 are arranged in parallel between the reinforcing bars S, which is the object to be bound, and the binding machine main body 10 such that the binding machine main body 10 cannot be placed between the reinforcing bars S1 arranged in parallel, the connection part 15A can be passed through and inserted into between the reinforcing bars S1 arranged in parallel, after which the guide part 13 can reach the position where the action position P1 of the guide part 13 is aligned to the reinforcing bar S. Further, as shown in FIG. 7B, even when the reinforcing bars S1 are arranged in the lattice shape, and the binding machine main body 10 cannot be placed between the lattices shaped by the reinforcing bars S1, the connection part 15A can be passed through and inserted into between the lattices shaped by the reinforcing bars S1, after which the guide part 13 can reach the position where the action position P1 of the guide part 13 is aligned to the reinforcing bar S.

In the reinforcing bar binding machine 1A, arrangements of the driving mechanisms such as the twisting motor 51 and the threaded shaft part 53, and the like are not modified, and the lengths of respective shapes of the guiding path 17, the driving force transmission member 18, and the advancing and retreating cylindrical part 54 are extended. Further, it is not required to modify designs of the driving mechanisms to be connected. That is, as shown in FIG. 2, the driving mechanisms such as the twisting motor 51 and the threaded shaft 53, and the like, all of which become the heavy objects disposed around the axis A3 of the handle part 11, are used without any modifications, and as described above, the lengths of the guiding path 17, the driving force transmission member 18, and the advancing and retreating cylindrical part 54 are formed to be extended, such that it is advantageously possible to use a basic configuration of a binding machine of the related art based upon the aforementioned configuration of the reinforcing bar binding machine 1A.

Since the connection part 15A can only house limited members such as the guiding path 17 of the wire W, the driving force transmission member 18 for the cutting part, and the like (for example, the motor, the housing part for the wire reel, and the like are not housed in the connection part), the shape thereof is formed to be very thin in comparison with the binding machine main body 10. Accordingly, even when the gap of the reinforcing bar S1 that is disposed in front of the reinforcing bar S, which is the object to be bound, is narrow, the guide part 13 can reach the position where the action position P1 of the guide part 13 is aligned to the reinforcing bar S.

Further, the reinforcing bar binding machine 1A is provided with the connection part 15A, such that a weight of a front side (the one end side in the extending direction A1 of the binding machine main body 10 with respect to the axis A3 of the handle part 11) increases more than the handle part 11.

However, the twisting motor 51 and the wire reel 20 are disposed at a rear side of the handle part 11, that is, the twisting motor 51 and the wire reel 20 are disposed at the other end side in the extending direction A1 of the binding machine main body 10 with respect to the axis A3 of the handle part 11, and further the feeding motor 32 is disposed in a vicinity of the axis A3 of the handle part 11, such that it is advantageously possible not only to prevent the front side thereof from being heavy, but also to appropriately maintain a weight balance therebetween.

That is, even though the connection part 15A is provided with the guiding path 17, the driving force transmission member 18, and the advancing and retreating cylindrical part 54, the weight of the connection part 15A becomes lighter in comparison with the binding machine main body 10 in which the twisting motor 51, the wire reel 20, and the like, all of which are the heavy object, are provided. Therefore, the weight balance between a front side of the handle part 11 and the rear side thereof can be desirably maintained, thereby having an effect of preventing the operability from deteriorating when the worker grips the handle part 11 and performs binding operation.

Next, action effect of the support part 16A of the connection part 15A will be described. In the reinforcing bar binding machine 1A, a direction, in which the handle part 11 is directed downward in the vertical direction, and the extending direction A1 of the binding machine main body 10 is in a state of being approximately horizontal, is referred to as an erected state. As shown in FIG. 1, there exists another reinforcing bar S1 between the reinforcing bar S, which is the object to be bound, and the binding machine main body 10. Accordingly, when the support part 16A of the connection part 15A is intended to be placed on the reinforcing bar S1, the binging operation becomes easier in the aforementioned erected state of the reinforcing bar binding machine 1A.

Since the support part 16A has a flat-shape, it is easy to place the support 16A on the reinforcing bar S1, and further when binding the reinforcing bar S, it becomes easy not only to move the binding machine main body 10 back and forth, but also to rotate the binding machine main body 10 vertically and horizontally in a state where the connection part 15A comes into contact with the reinforcing bar S1. Further, the binding operation can be performed while a weight of the reinforcing bar binding machine 1A is being supported by the reinforcing bar S, thereby having an effect of reducing burden of the worker and improving operating efficiency.

When using the reinforcing bar binding machine 1A based upon the aforementioned configuration, the connection part 15A that comes into contact with the reinforcing bar S1, and the like is desirably made of a metallic material in consideration of durability thereof, but may be made of a resin material.

Figure 8:
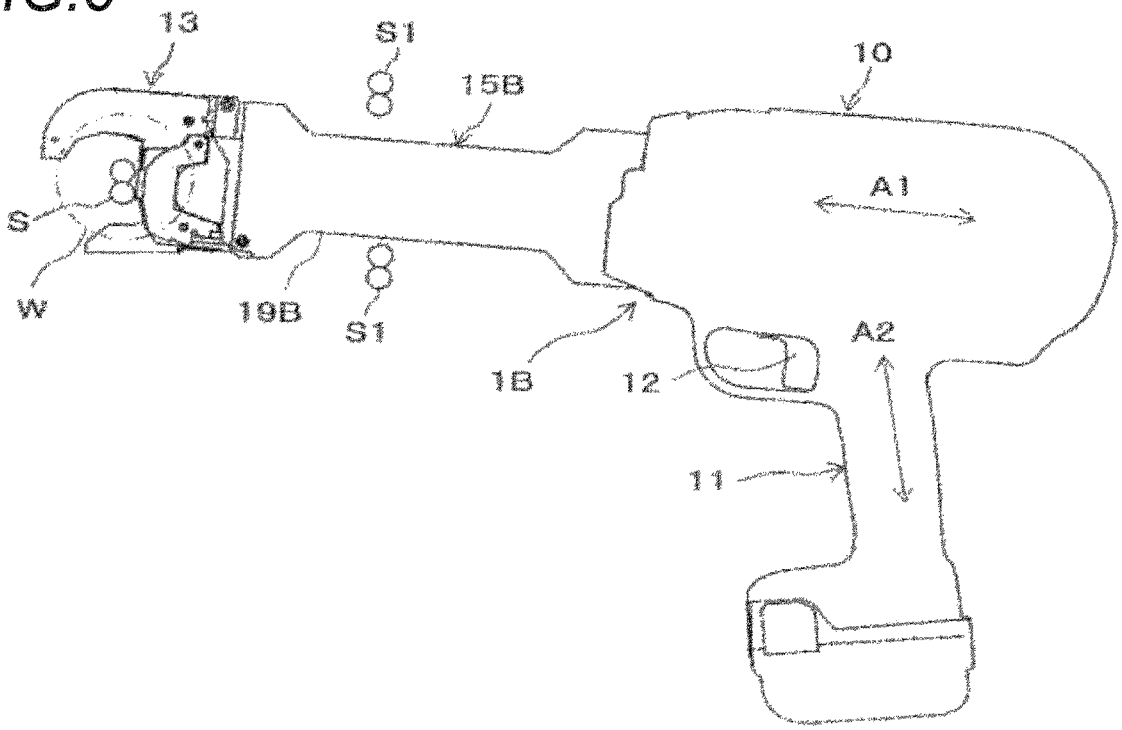
FIG. 8 is a diagram illustrating an example of an overall configuration of a reinforcing bar binding machine according to a second embodiment, when viewed from one side.

Configuration Example of Reinforcing Bar Binding Machine According to Second Embodiment FIG. 8 is a diagram illustrating an example of an overall configuration of a reinforcing bar binding machine according to a second embodiment, when viewed from one side. Further, same numbers in a reinforcing bar binding machine 1B according to a second embodiment will be provided to parts, configurations of which are the same as those of the reinforcing bar binding machine 1A according to the first embodiment in FIG. 1, and the like, and detailed descriptions thereof will be omitted.

The reinforcing bar binding machine 1B is provided with a connection part 15B that is not only capable of guiding the guide part 13 to the position where the reinforcing bar S, which is the object to be bound, is provided, but also capable of aligning the action position P1 of the guide part 13 to the reinforcing bar S. The connection part 15B is also referred to as an extension part, and has a shape extending in one direction in the extending direction A1 of the binding machine main body 10.

The guide part 13 is provided at a tip side of the connection part 15B (an end part in one direction of the connection part 15B). Further, the twisting hook 55 (not shown in FIG. 8) of the binding part 5 shown in FIG. 2 is provided at an inside of the tip side of the connection part 15B.

The connection part 15B is desirably formed of a metallic material. Meanwhile, an exterior part may be formed of the metallic material, and an interior part may be formed of the resin material. The connection part 15B is provided with retreating parts 19B having recessed shapes that are respectively formed on a lower-side surface and an upper-side surface when the handle part 11 is directed downward in the vertical direction. The retreating part 19B is provided to easily retreat the connection part 15B from the reinforcing bar 51. That is, the retreating part 19B is provided to easily move the connection part 15B at an inside of the lattice of the reinforcing bar S1 (Specifically, the retreating part 19B is provided to move the connection part 15B in an up-and-down direction, or to easily rotate the connection part 15B at the inside thereof). When a cross-sectional shape of the connection part 15B is a quadrangular shape, the retreating part 19B may be provided on all of the four-side surfaces (provided on a lower-side surface, an upper-side surface, a right-side surface, and a left-side surface).

Example of Action of Reinforcing Bar Binding Machine of Second Embodiment

Next, action effect of the retreating part 19B will be described. As shown in FIG. 8, when another reinforcing bar S1 exists between the reinforcing bars S, which is the object to be bound, and the binding machine main body 10, the connection part 15B is inserted into between the reinforcing bars S1, after which the reinforcing bar binding machine 1B is rotated around the extending direction A1 as an axis and a direction thereof is changed so as to align the action position P1 of the guide part 13 to the reinforcing bar S.

In this case, for example, when an opening area of the lattice is narrow such that the guide part 13 has difficulty in entering into the opening area thereof, and an overall height of the connection part 15B and an overall width thereof are almost same as an overall height of the guide part 13 and overall width thereof, the connection part 15B comes in contact with the lattice after the guide part 13 passes through the lattice. Accordingly, the connection part 15B is not movable in the up-and-down direction, and not rotatable. As a result, the guide part 13 cannot move in a desired direction. However, the connection part 15B is provided with the retreating part 19B having the recessed shape, such that the connection part 15B is movable in the up-and-down direction and rotatable even when the aforementioned narrow opening area of the lattice exists. Therefore, the guide part 13 is movable in a predetermined direction, such that the action position P1 of the guide part 13 can be aligned to the reinforcing bar S. Further, in the embodiment, the retreating parts 19 are respectively provided on the lower-side surface of the connection part 15B and the upper-side surface thereof, but may not be limited to the aforementioned configuration. For example, the retreating part 19 may be only provided on the upper-side surface thereof, the lower-side surface thereof, or side surfaces thereof, and further may be provided around the whole periphery thereof.

Figure 9:
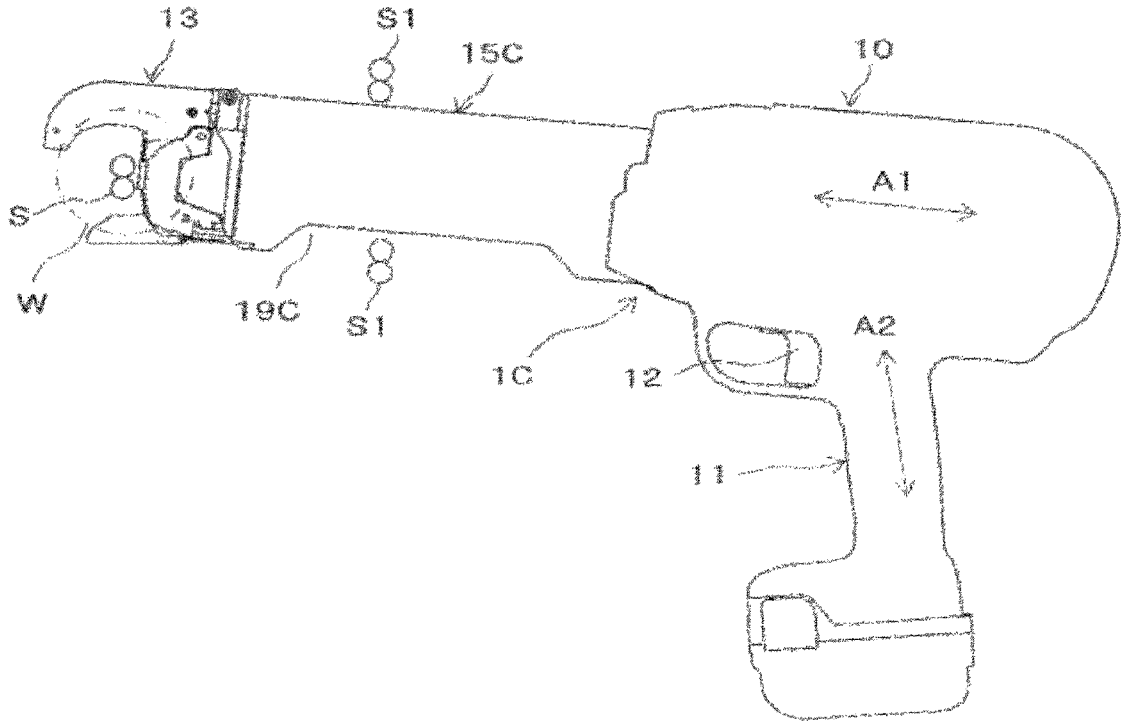
FIG. 9 is a diagram illustrating an example of an overall configuration of a reinforcing bar binding machine according to a third embodiment, when viewed from one side.
Figure 10:
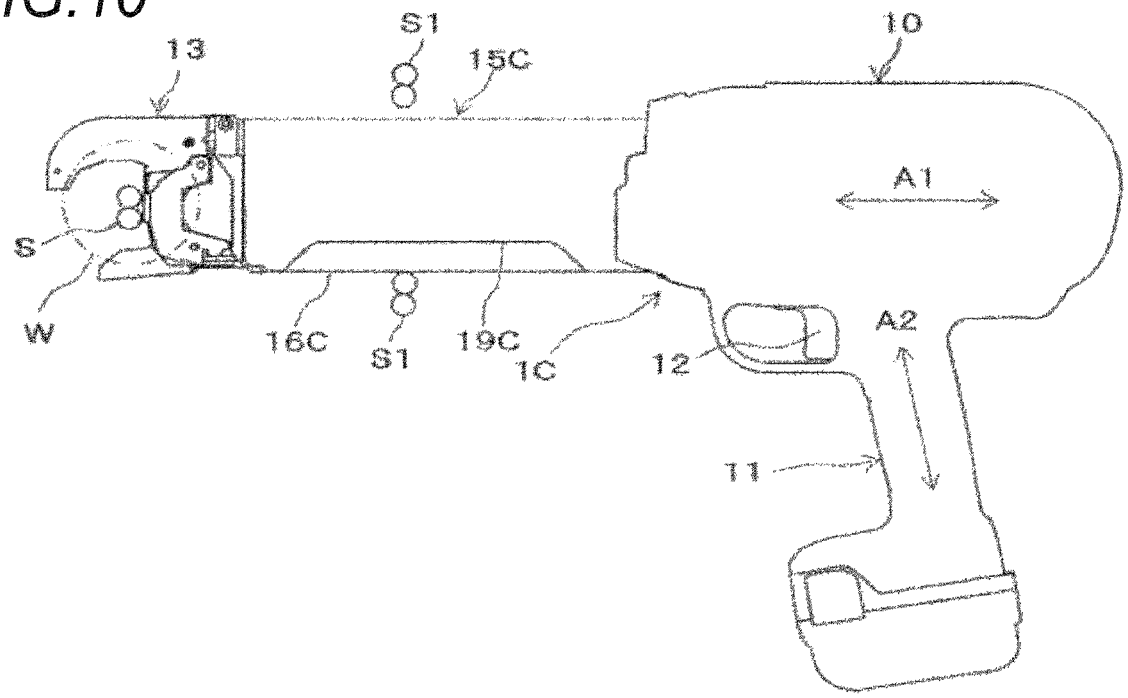
FIG. 10 is a diagram illustrating the example of the overall configuration of the reinforcing bar binding machine according to the third embodiment, when viewed from one side.

Configuration Example of Reinforcing Bar Binding Machine According to Third Embodiment FIGS. 9 and 10 are diagrams illustrating an example of an overall configuration of a reinforcing bar binding machine according to a third embodiment, when viewed from one side. Further, same numbers in a reinforcing bar binding machine 1C according to a third embodiment will be provided to parts, configurations of which are the same as those of the reinforcing bar binding machine 1A according to the first embodiment in FIG. 1, and the like, and detailed descriptions thereof will be omitted.

The reinforcing bar binding machine 1C is provided with a connection part 15C that is not only capable of guiding the guide part 13 to the position where the reinforcing bar S, which is the object to be bound, is provided, but also capable of aligning the action position P1 of the guide part 13 to the reinforcing bar S. The connection part 15C is also referred to as an extension part, and has a shape extending in one direction in the extending direction A1 of the binding machine main body 10.

The guide part 13 of the reinforcing bar binding machine 1C is provided at a tip side of the connection part 15C (an end part in one direction of the connection part 15C). Further, the twisting hook 55 (not shown in FIGS. 9 and 10) of the binding part 5 shown in FIG. 2 is provided at an inside of the tip side of the connection part 15C.

The connection part 15C is desirably formed of a metallic material. Meanwhile, the connection part may be formed of a resin material, or an exterior part may be formed of the metallic material, and an interior part may be formed of the resin material. The connection part 15C is provided with a retreating part 19C having almost same function and shape as those of the retreating part 19B according to the second embodiment. The connection part 15C is additionally provided with a support part 16C that is detachable to the retreating part 19C.

The retreating part 19C is formed such that at least one side surface of the connection part 15C in the extending direction A1 of the binding machine main body 10 has a recessed shape. When the support part 16C is mounted on the retreating part 19C, the side surface of the connection part 15C provided with the retreating part 19C becomes a flat shape.

Example of Action of Reinforcing Bar Binding Machine of Third Embodiment

Next, action effect of the support part 16C that is removable (that is, attachable and detachable to) from the retreating part 19C will be described. As shown in FIG. 9, when another reinforcing bar S1 exists between the reinforcing bars S, which is the object to be bound, and the binding machine main body 10, the connection part 15C is inserted into between the reinforcing bars S1, after which the reinforcing bar binding machine 1C is required to be slightly rotated around the extending direction A1 as an axis, and a direction thereof is required to be changed so as to align the action position P1 of the guide part 13 to the reinforcing bar S.

In this case, the same effect as that of the retreating part 19B according to the second embodiment can be accomplished by removing the support part 16C from the retreating part 19C.

On the other hand, as shown in FIG. 10, the same effect as that of the support part 16A of the connection part 15A according to the first embodiment can be accomplished by mounting the support part 16C on the retreating part 19C. That is, the support part 16C has a reversible function in which the support part 16C can be mounted with the retreating part 19C, and can be removed therefrom. Accordingly, it is advantageously possible to switch an operation state in which a function of the retreating part 19C (the reinforcing bar binding machine 1C is slightly rotatable) is performed to another operation state in which the support part 16C is placed on the reinforcing bar S1 and then is moved.

Figure 11:
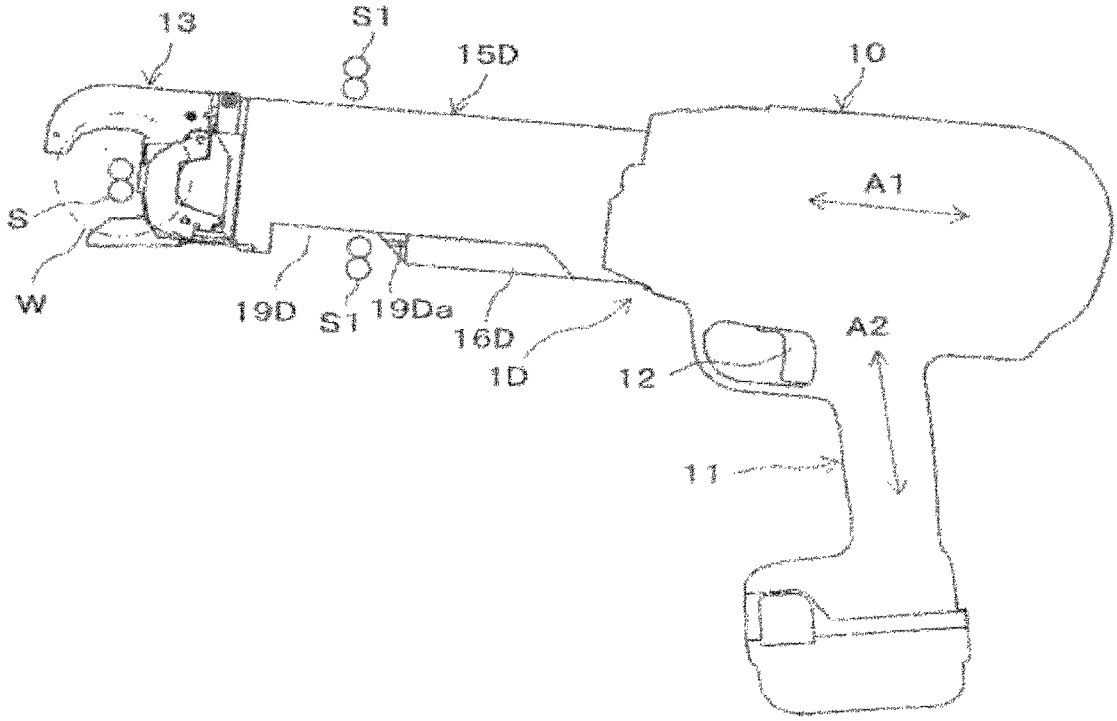
FIG. 11 is a diagram illustrating an example of an overall configuration of a reinforcing bar binding machine according to a fourth embodiment, when viewed from one side.
Figure 12:
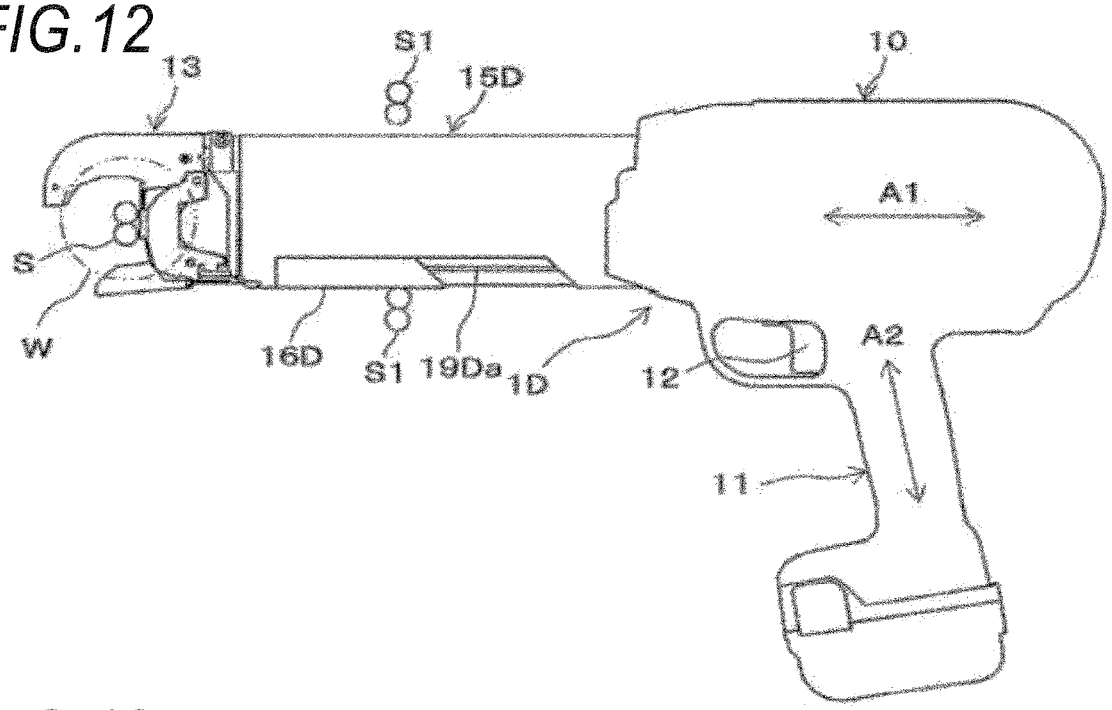
FIG. 12 is a diagram illustrating the example of the overall configuration of the reinforcing bar binding machine according to the fourth embodiment, when viewed from one side.

Configuration Example of Reinforcing Bar Binding Machine According to Fourth Embodiment FIGS. 11 and 12 are diagrams illustrating an example of an overall configuration of a reinforcing bar binding machine according to a fourth embodiment, when viewed from one side. Further, same numbers in a reinforcing bar binding machine 1D according to a fourth embodiment will be provided to parts, configurations of which are the same as those of the reinforcing bar binding machine 1A according to the first embodiment in FIG. 1, and the like, and detailed descriptions thereof will be omitted.

The reinforcing bar binding machine 1D is provided with a connection part 15D that is not only capable of guiding the guide part 13 to the position where the reinforcing bar S, which is the object to be bound, is provided, but also capable of aligning the action position P1 of the guide part 13 to the reinforcing bar S. The connection part 15D is also referred to as an extension part, and has a shape extending in one direction in the extending direction A1 of the binding machine main body 10.

The guide part 13 of the reinforcing bar binding machine 1D is provided at a tip side of the connection part 15D (an end part in one direction of the connection part 15D). Further, the twisting hook 55 (not shown in FIGS. 11 and 12) of the binding part 5 shown in FIG. 2 is provided at an inside of the tip side of the connection part 15D.

The connection part 15D is desirably formed of a metallic material. Meanwhile, the connection part may be formed of a resin material, or an exterior part may be formed of the metallic material, and an interior part may be formed of the resin material. The connection part 15D is provided with a retreating part 19D which retreats the binding machine main body 10 and the connection part 15D from the reinforcing bar S1, and the like; and a support part 16D which is provided to be movable with respect to the connection part 15D and supports the binding machine main body 10 and the connection part 15D on the reinforcing bar S1, and the like.

The retreating part 19D is formed such that at least one side surface of the connection part 15D in the extending direction A1 of the binding machine main body 10 has a recessed shape. The support part 16D is supported by a rail part 19 Da to be movable between a retreat position in which the retreating part 19D is exposed and a support position in which the retreating part 19D is covered. Accordingly, when the support part 16D moves to the support position, the side surface of the connection part 15D provided with the retreating part 19D becomes a flat shape.

Example of Action of Reinforcing Bar Binding Machine of Fourth Embodiment

Next, action effect of the support part 16D that is capable of opening and closing the retreating part 19D will be described. As shown in FIG. 11, when another reinforcing bar S1 exists between the reinforcing bars S, which is the object to be bound, and the binding machine main body 10, the connection part 15D is inserted into between the reinforcing bars S1, after which the reinforcing bar binding machine 1D is required to be slightly rotated around the extending direction A1 as an axis, and a direction thereof is required to be changed so as to align the action position P1 of the guide part 13 to the reinforcing bar S.

In this case, the retreating part 19D is exposed by moving the support part 16D to the retreat position, such that the retreating part 19D can be used as the retreating part 19B according to the second embodiment.

On the other hand, as shown in FIG. 12, the retreating part 19D is covered by moving the support part 16D to the support position, such that the support part 16D can be used as the support part 16A according to the first embodiment. That is, the support part 16D has a reversible function in which the support part 16D can moved be in the retreat position where the retreating part 19D is exposed, and can be switched from the retreat position to the support position where the retreating part 19D is covered. Accordingly, it is advantageously possible to switch an operation state in which a function of the retreating part 19D (the reinforcing bar binding machine 1D is slightly rotatable) is performed to another operation state in which the support part 16D is placed on the reinforcing bar S1 and then is moved.

Figure 13:
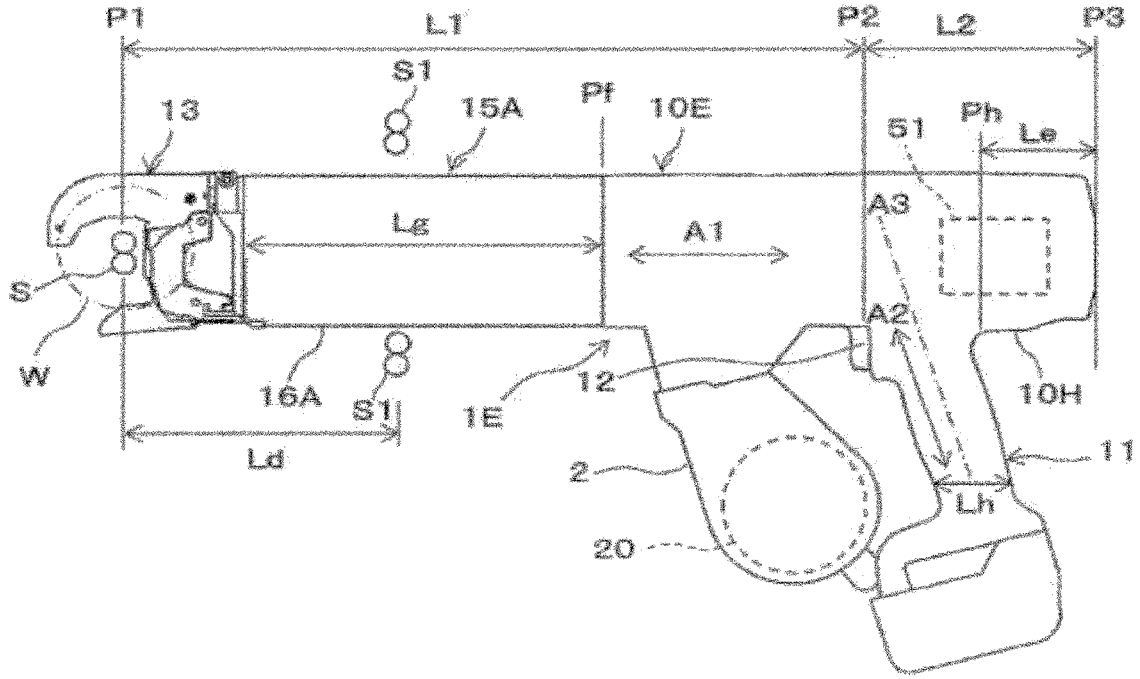
FIG. 13 is a diagram illustrating an example of an overall configuration of a reinforcing bar binding machine according to a fifth embodiment, when viewed from one side.

Configuration Example of Reinforcing Bar Binding Machine According to Fifth Embodiment FIG. 13 is a diagram illustrating an example of an overall configuration of a reinforcing bar binding machine according to a fifth embodiment, when viewed from one side. Further, same numbers in a reinforcing bar binding machine 1E according to a fifth embodiment will be provided to parts, configurations of which are the same as those of the reinforcing bar binding machine 1A according to the first embodiment in FIG. 1, and the like, and detailed descriptions thereof will be omitted.

The reinforcing bar binding machine 1E is provided with the housing part 2 in the front of the handle part 11. The housing part 2 is formed to be provided in the binding machine main body 10E. Meanwhile, the housing part 2 may be formed to be provided as an external part separated from the binding machine main body 10E, and may be provided at the other end side of the binding machine main body 10E in the extending direction A1 with respect to one end Pf of the binding machine main body 10E.

Even in the aforementioned configuration in which the housing part 2 is provided in the front of the handle part 11, the twisting motor 51 is disposed at the rear side of the handle part 11. Accordingly, the weight balance between the front side of the handle part 11 and the rear side thereof can be desirably maintained, thereby having an effect of improving the operability when the worker grips the handle part 11 and performs the binding operation.

Further, when at least one of the housing part 2 and the twisting motor 51 is formed to be provided at the other end side in the extending direction A1 of the binding machine main body 10 with respect to the axis A3 of the handle part 11, it is advantageously possible to maintain the weight balance between the one end side in the extending direction A1 of the binding machine main body 10 and the other end side in the extending direction A1 of the binding machine main body 10 with respect to the axis A3 of the handle part 11.

Figure 14:
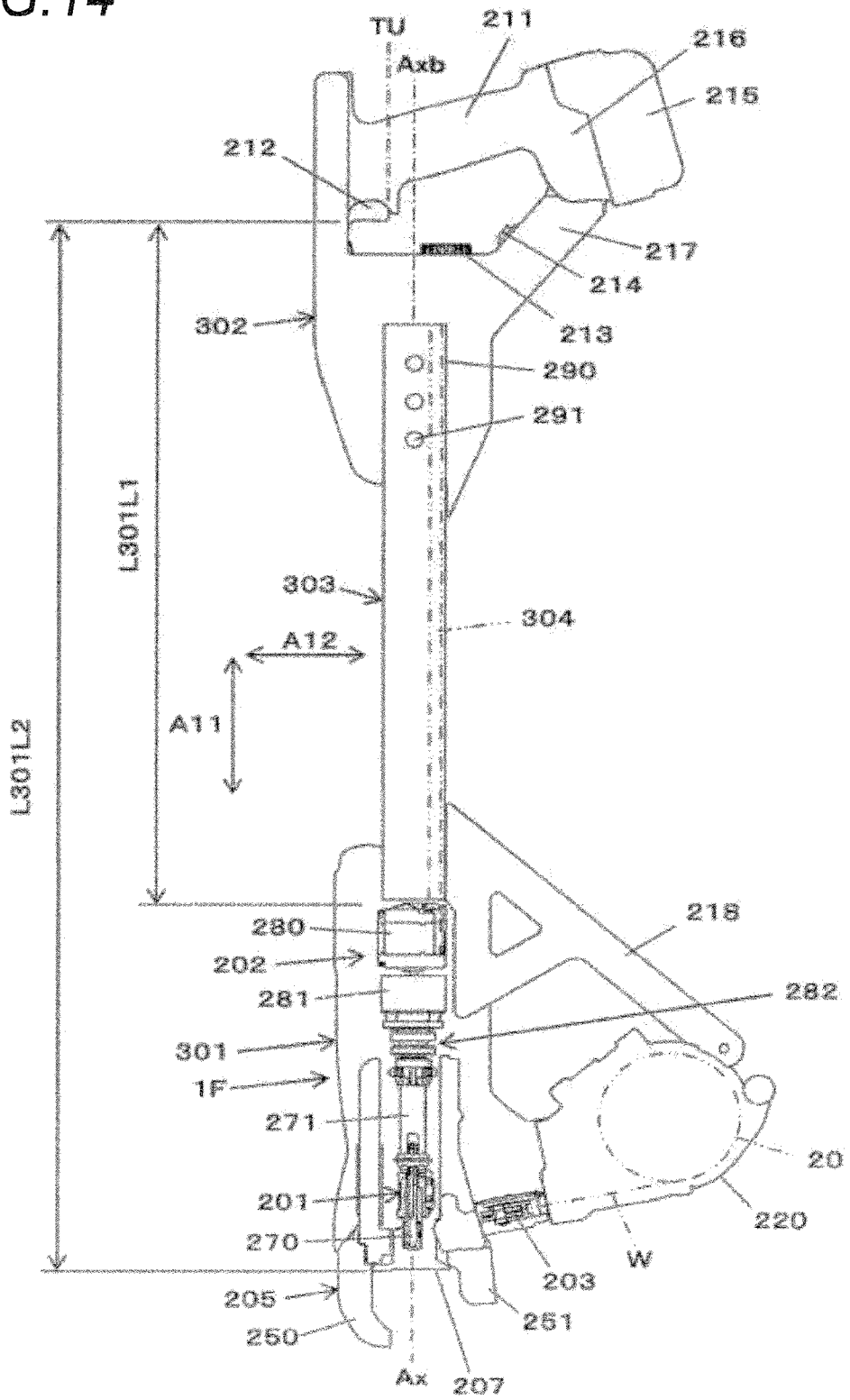
FIG. 14 is a side-view illustrating an example of an internal configuration of a reinforcing bar binding machine according to a sixth embodiment.
Figure 15:
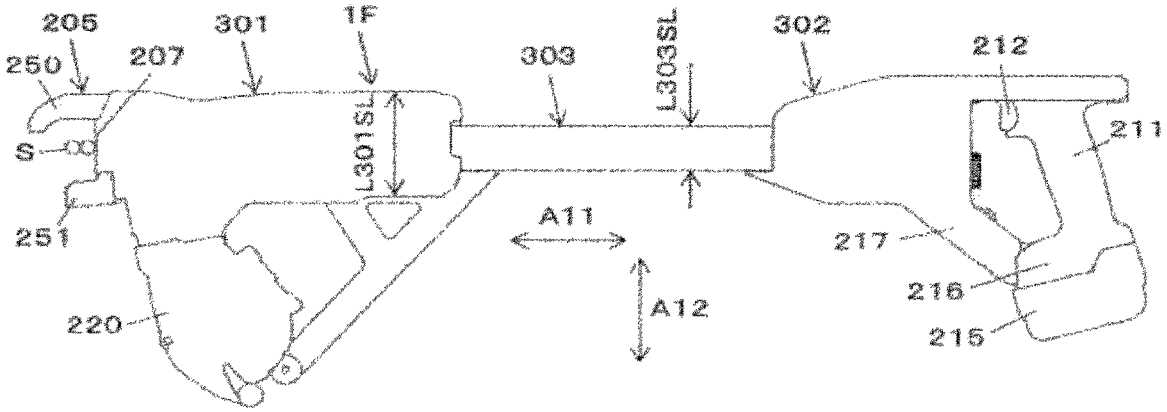
FIG. 15 is a side-view illustrating an example of an overall configuration of the reinforcing bar binding machine according to the sixth embodiment.
Figure 16:
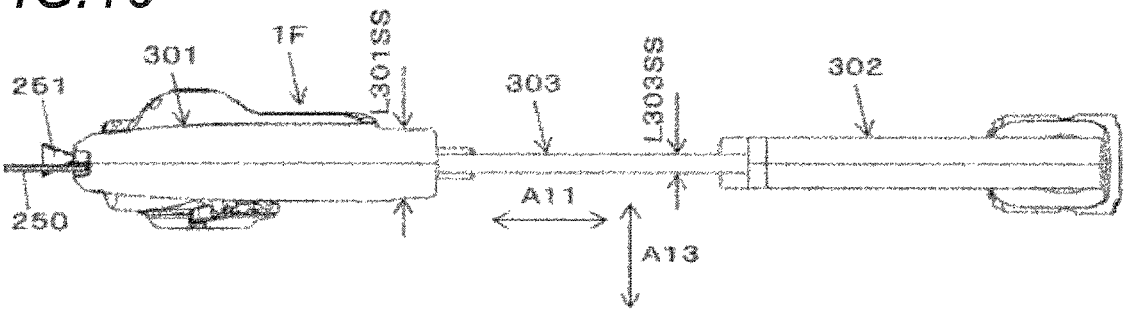
FIG. 16 is a top view illustrating the example of the overall configuration of the reinforcing bar binding machine according to the sixth embodiment.
Figure 17:
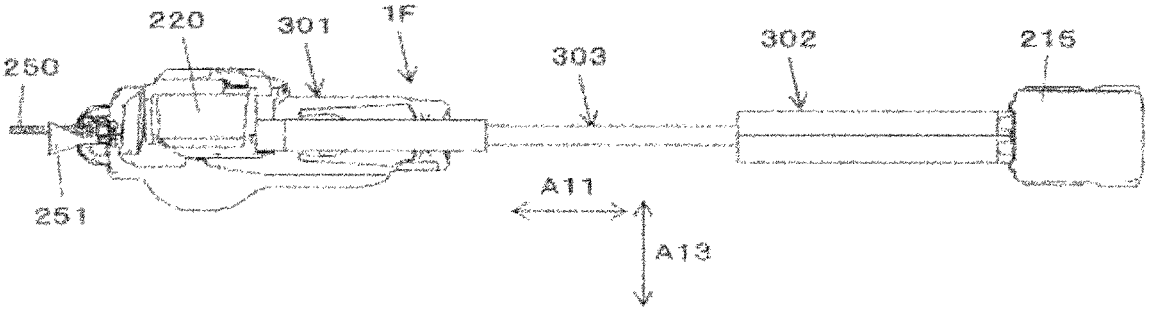
FIG. 17 is a bottom view illustrating the example of the overall configuration of the reinforcing bar binding machine according to the sixth embodiment.

Configuration Example of Reinforcing Bar Binding Machine According to Sixth Embodiment FIG. 14 is a side-view illustrating an example of an internal configuration of a reinforcing bar binding machine according to a sixth embodiment; FIG. 15 is a side-view illustrating an example of an overall configuration of the reinforcing bar binding machine according to the sixth embodiment; FIG. 16 is a top view illustrating the example of the overall configuration of the reinforcing bar binding machine according to the sixth embodiment; and FIG. 17 is a bottom view illustrating the example of the overall configuration of the reinforcing bar binding machine according to the sixth embodiment.

Figure 18:
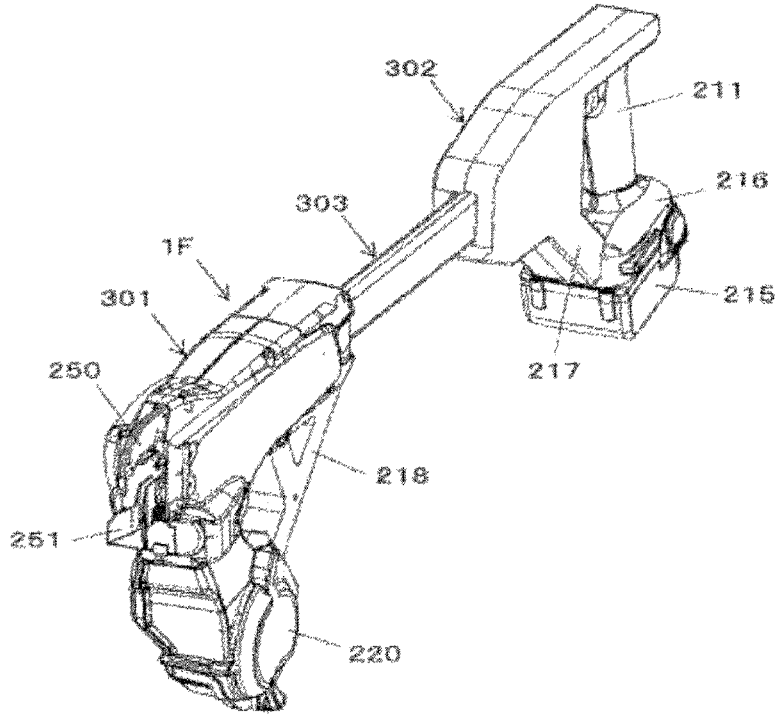
FIG. 18 is a perspective view illustrating the example of the overall configuration of the reinforcing bar binding machine according to the sixth embodiment.
Figure 19:
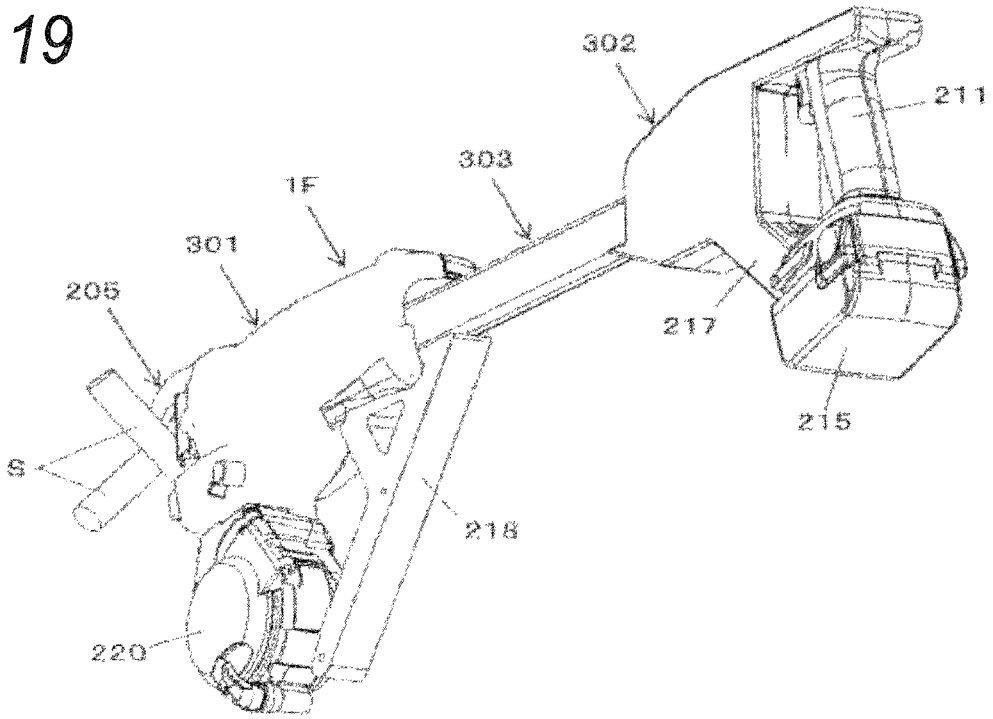
FIG. 19 is a perspective view illustrating the example of the overall configuration of the reinforcing bar binding machine according to the sixth embodiment.
Figure 20:
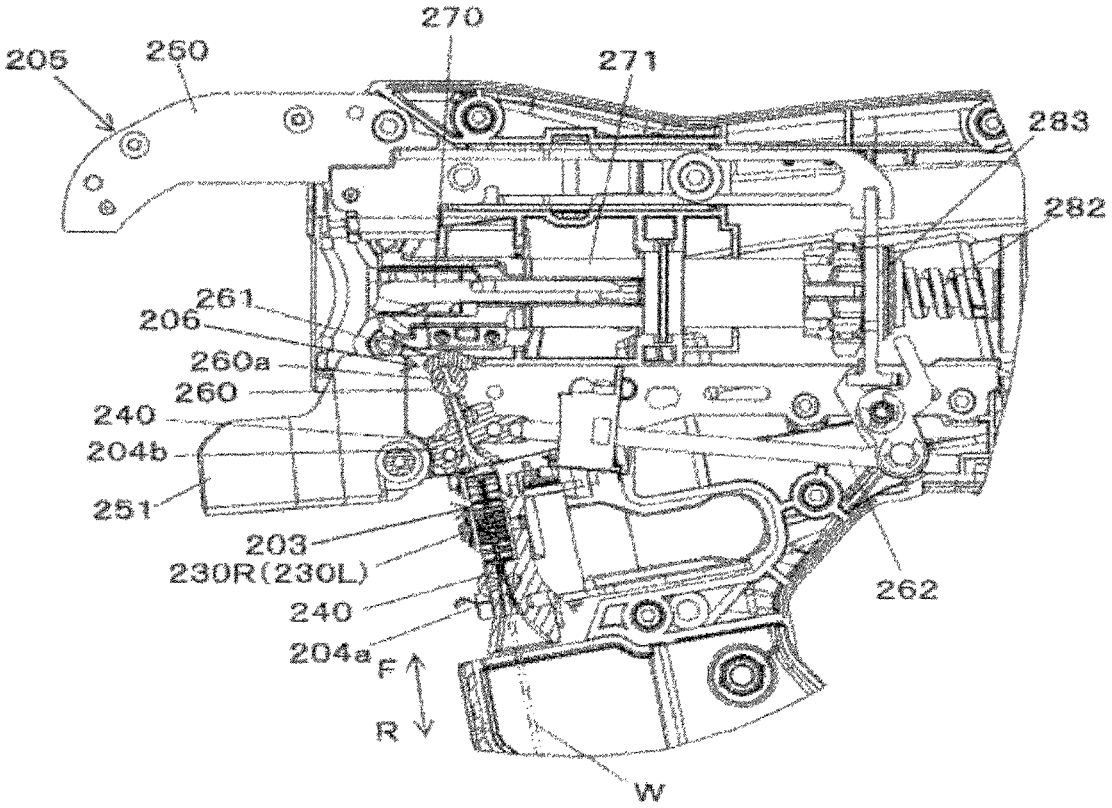
FIG. 20 is a side-view illustrating an example of a configuration of a principal part of the reinforcing bar binding machine according to the sixth embodiment.
Figure 21:
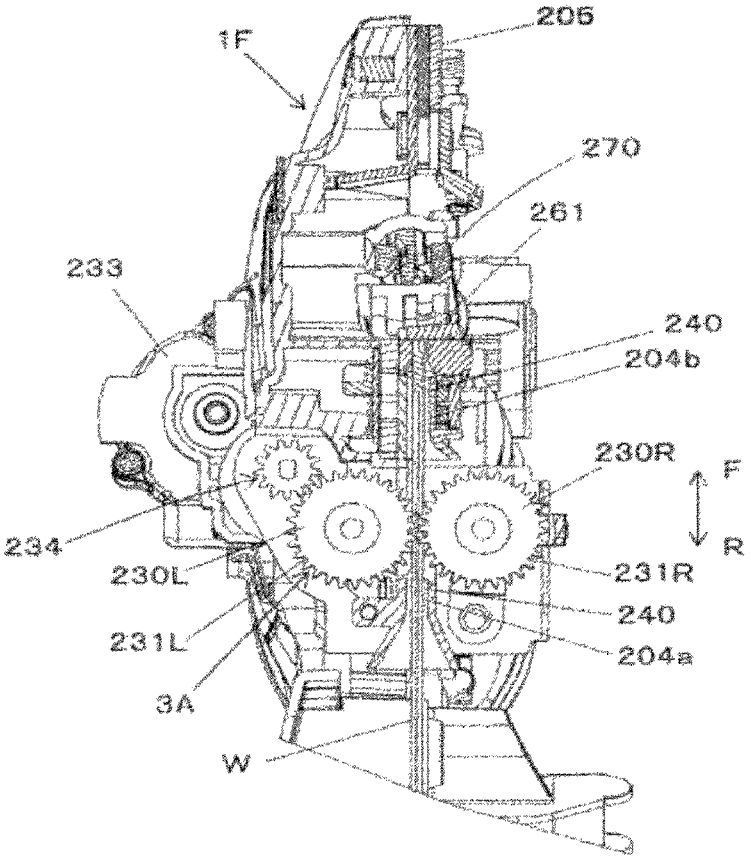
FIG. 21 is a front-view illustrating the example of the configuration of the principal part of the reinforcing bar binding machine according to the sixth embodiment.

Further, FIGS. 18 and 19 are perspective views illustrating the example of the overall configuration of the reinforcing bar binding machine according to the sixth embodiment. Additionally, FIG. 20 is a side-view illustrating an example of a configuration of a principal part of the reinforcing bar binding machine according to the sixth embodiment; and FIG. 21 is a front-view illustrating the example of the configuration of the principal part of the reinforcing bar binding machine according to the sixth embodiment.

A reinforcing bar binding machine 1F according to the sixth embodiment is provided with a first main body 301 in which a binding part 201 for twisting the wire W and a driving part 202 for driving the binding part 201, and the like are housed; a second main body 302 in which a handle part 211 including an operation trigger 212 is provided; and a bridge part 303 which connects the first main body 301 and the second main body 302 to each other.

In the reinforcing bar binding machine 1F, the first main body 301 and the second main body 302 are connected to each other by the bridge part 303, such that a distance between the binding part 201 and the handle part 211 extends more than a reinforcing bar binding machine of the related art that is not provided with the bridge part 303.

The first main body 301 is provided with the binding part 201 at one side with respect to a direction in which the reinforcing bar binding machine 1F is extended by the bridge part 303 (a direction shown by an arrow A11). Further, the bridge part 303 is connected to the other side of the first main body 301 in the direction shown by the arrow A11.

The binding part 201 is provided with a gripping part 270 for gripping the wire W; and an operation part 271 for rotating the gripping part 270 which grips the wire W. The gripping part 270 twists the wire W that is wound around the reinforcing bar S by gripping and rotating the wire W by operating the operation part 271.

The driving part 202 is provided with a twisting motor 280 which drives the binding part 201, and the like; a reduction gear 281 with which deceleration and torque-amplification are performed; and a rotating shaft 282 that is driven and rotated by the twisting motor 280 via the reduction gear 281.

The driving part 202 moves the operation part 271 in an axial direction of the rotating shaft 282 by performing rotation operation of the rotating shaft 282. As described above, the operation part 271 moves in the axial direction of the rotating shaft 282, such that the gripping part 270 grips the wire W. The driving part 202 rotates the operation part 271 moving in the axial direction of the rotating shaft 282 by performing the rotation operation of the rotating shaft 282. The operation part 271 rotates around the axis of the rotating shaft 282, thereby twisting the wire W by the gripping part 270.

In the binding part 201 and the driving part 202, the gripping part 270, the operation part 271, the rotating shaft 282, the reduction gear 281 and the twisting motor 280 are arranged in the direction shown by the arrow A11. The twisting motor 280 of the driving part 202 is provided at the other side with respect to the direction shown by the arrow A11 in the first main body 301.

Further, an axis of the twisting motor 280, the rotating shaft 282, and a rotation center of the operation part 271 and the gripping part 270 are coaxially disposed. The axis of the twisting motor 280, the rotating shaft 282, and the rotation center of the operation part 271 and the gripping part 270 are referred to as an axis Ax of the binding part 201.

In the second main body 302, the bridge part 303 is connected to one side with respect to the direction shown by the arrow A11. Further, the second main body 302 is provided with the handle part 211 on the other side with respect to the direction shown by the arrow A11.

The handle part 211 extends in a direction that is almost orthogonal to the direction shown by the arrow A11 and is not parallel therewith. The second main body 302 is connected to an upper end part of the handle part 211, which is one side in the extending direction.

The operation trigger 212 is provided at the upper end part of the handle part 211 which is one side in the extending direction of the handle part 211, and can be operated mainly by using a forefinger of a hand gripping the handle part 211. Further, the second main body 302 is provided with an operation dial 213 which adjusts binding force according to the wire W; and a switch 214 which switches a power source ON and OFF.

The handle part 211 is provided with a battery mounting part 216 in which a battery 215, which is the power source, is detachably mounted, at a lower end part, which is the other side in the extending direction. Further, the battery mounting part 216 and the second main body 302 are connected to each other by a connection part 217, such that the upper end part and the lower end part of the handle part 211 are connected to the second main body 302 at both sides of the handle part 211, thereby having an effect of improving strength.

Hereinafter, another configuration of the reinforcing bar binding machine 1F will be described. The reinforcing bar binding machine 1F is provided with a magazine 220 as a housing part in which the wire W is housed; and a wire feeding part 203 which pulls the wire W from the magazine 220 and feeds the wire.

The reinforcing bar binding machine 1F is provided with a curl guide 205 which curls the wire W fed by the wire feeding part 203 in the periphery of the reinforcing bar S; a cutting part 206 which cuts the wire W curled in the reinforcing bar S; and a contact part 207 that comes into contact with the reinforcing bar S.

Further, as operation of feeding the wire W in a forward direction shown by an arrow F, the reinforcing bar binding machine 1F is provided with a first wire guide 204*a* which guides the wire W from the magazine 220 to the wire feeding part 203; and a second wire guide 204*b* which guides the wire W fed out from the wire feeding part 203 to the cutting part 206.

The magazine 220 is provided in the first main body 301 in the embodiment, and rotatably and detachably houses the reel 20 around which the wire is wound to be fed. The magazine 220 and the first main body 301 are connected to each other by a connection part 218, thereby having an effect of improving strength.

In the reinforcing bar binding machine 1F, two wires W are wound around the reel 20 to be fed, so as to bind reinforcing bar S by the two wires W. The wire W is formed of a plastically deformable metal wire. Alternatively, the metal wire may be a wire covered with a resin material or a twisted wire, and the like.

Figure 22:
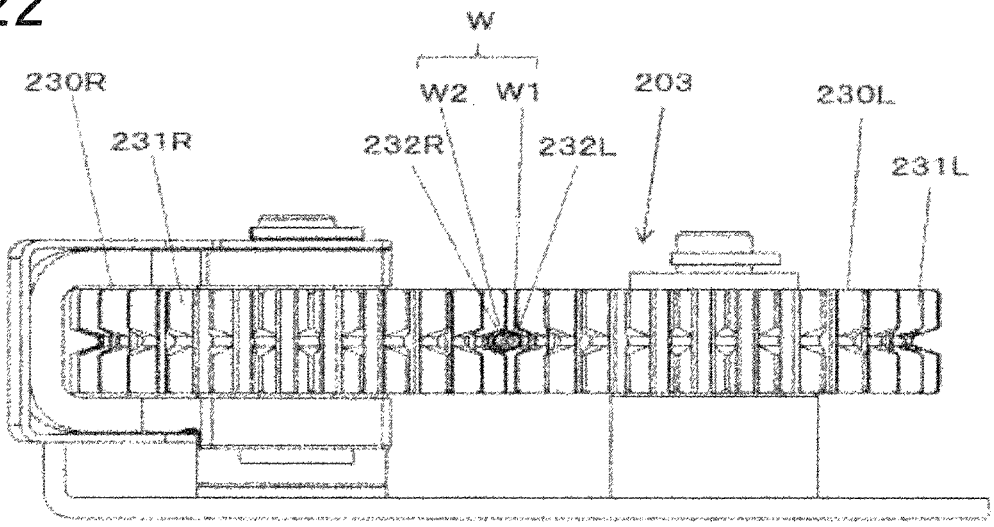
FIG. 22 is a diagram illustrating an example of a configuration of a principal part of a wire feeding part.

FIG. 22 is a diagram illustrating an example of a configuration of a principal part of a wire feeding part. The wire feeding part 203 is provided in the first main body 301 and includes a pair of feeding members which sandwich two wires disposed in parallel therebetween and feed the two wires by rotation operation. Further, the wire feeding part 203 is provided with a first feeding gear (a first feeding member) 230L and a second feeding gear (a second feeding member) 230R as a pair of feeding members.

A tooth part 231L for transmitting driving force around the whole periphery is formed on an outer peripheral surface of the first feeding gear 230L. The tooth part 231L in the embodiment has a shape forming a spur gear. In the first feeding gear 230L, a groove part 232L, into which the wire W enters in a circumferential direction, is formed on the whole periphery of the outer peripheral surface. The groove part 232L in the embodiment is formed of a recessed part having an approximately V-shape in a cross-sectional view.

The second feeding gear 230R is also formed with a tooth part 231R for transmitting driving force and a groove part 232R into which the wire W enters on an outer peripheral surface of the second feeding gear 230R in the same manner as that of the first feeding gear 230L. The tooth part 231R has a shape forming a spur gear, and the groove part 232R is formed of a recessed part having an approximately V-shape in a cross-sectional view.

The groove part 232L of the first feeding gear 230L and the groove part 232R of the second feeding gear 230R are provided to be opposite to each other with a feeding path of the wire W sandwiched therebetween.

The wire feeding part 203 loads the wire W between the first feeding gear 230L and the second feeding fear 230R, and is formed to be movable in a direction where the first feeding gear 230L and the second feeding fear 230R are separated from each other and in a direction where the first feeding gear 230L and the second feeding fear 230R approach each other, so as to sandwich the wire W therebetween. The first feeding gear 230L and the second feeding gear 230R are pressed in a direction where the first feeding gear 230L and the second feeding gear 230R approach each other by energizing members such as a spring (not shown), and the like.

The wire feeding part 203 is formed such that the tooth part 231L of the first feeding gear 230L and the tooth part 231R of the second feeding gear 230R are engaged with each other in a state where the wire W is sandwiched between the groove part 232L of the first feeding gear 230L and the groove part 232R of the second feeding gear 230R. Accordingly, driving force generated by rotation is transmitted between the first feeding gear 230L and the second feeding gear 230R.

The wire feeding part 203 incudes a feeding motor 233 and a driving force transmission mechanism 234, which are an example of a wire feeding driving part. The feeding motor 233 drives one of a first feeding gear 230L and a second feeding gear 230R. In the embodiment, the feeding motor 233 drives the first feeding gear 230L. The driving force transmission mechanism 234 transmits driving force of the feeding motor 233 to the first feeding gear 230L.

Rotation operation of the feeding motor 233 is transmitted to the first feeding gear 230L via the driving force transmission mechanism 234, such that the first feeding gear 230L rotates. Rotation operation of the first feeding gear 230L is transmitted to the second feeding gear 230R by the engagement between the tooth parts 231L and 231R, such that the second feeding gear 230R rotates following the rotation of the first feeding gear 230L.

Accordingly, the wire feeding part 203 feeds the wire W that is sandwiched between the first feeding gear 230L and the second feeding gear 230R in an extending direction of the wire W. According to the configuration in which two wires W are fed, the two wires are fed in parallel by frictional force that is generated between the groove part 232L of the first feeding gear 230L and one wire W1; and frictional force that is generated between the groove 232R of the second feeding gear 230R and the other wire W2.

In the wire feeding part 203, rotation directions of the first feeding gear 230L and the second feeding gear 230R are switched by switching the rotation direction of the feeding motor 233, and thus consequently a feeding direction of the wire W is switched.

Next, the wire guide which guides the feeding of the wire W will be described. The first wire guide 204*a* is an example of the wire guide, and is disposed at an upstream side of the first feeding gear 230L and the second feeding gear 230R with respect to the feeding direction of the wire W fed in the forward direction. Further, the second wire guide 204*b* is disposed at a downstream side of the first feeding gear 230L and the second feeding gear 230R, more specifically, disposed between the first feeding gear 230L and the second feeding gear 230R, and the cutting part 206, with respect to the feeding direction of the wire W fed in the forward direction.

The first wire guide 204*a* and the second wire guide 204*b* are provided with a guide hole 240 through which the wire W passes. The guide hole 240 has a shape for restricting a position of the wire W in a radial direction. According to the configuration in which the two wires W are fed, the guide hole 240 having a shape for passing the two wires W in parallel is formed in the first wire guide 204*a* and the second wire guide 204*b*.

The guide hole 240 is provided on the feeding path of the wire W that passes through between the first feeding gear 230L and the second feeding gear 230R. The first wire guide 204*a* guides the wire W passing through the guide hole 240 to the feeding path disposed between the first feeding gear 230L and the second feeding gear 230R.

Next, configurations of molding of the wire W and cutting the wire W will be described. The contact part 207 is provided in the first main body 301, and comes into contact with the reinforcing bar S, such that a position between the reinforcing bar S and the curl guide 205 is approximately aligned.

The curl guide 205 is provided in the first main body 301 and is provided with a first guide 250 for providing a curling tendency on the wire W that is fed by the first feeding gear 230L and the second feeding gear 230R; a second guide 251 for guiding the wire W that is fed from the first guide 250 to the binding part 201.

The cutting part 206 is provided in the first main body 301 and includes a stationary blade part 260; a movable blade part 261 which cuts the wire W in cooperation with the stationary blade part 260; and a transmission mechanism 262 which transmits driving force of the driving part 202 to the movable blade part 261. The stationary blade part 260 is provided with an opening part 260*a* through which the wire W passes, and the opening 260*a* is provided with an edge part capable of cutting the wire W.

The movable blade part 261 cuts the wire W passing through the opening part 260*a* of the stationary blade part 260 by rotation operation with the stationary blade part 260 as a fulcrum.

The driving part 202 is provided with a moving member 283 which transmits the driving force to the transmission mechanism 262 of the cutting part 206. The moving member 283 moves in the axial direction of the rotating shaft 282 by the rotation operation of the rotating shaft 282. The transmission mechanism 262 converts movement of the moving member 283 in the axial direction of the rotating shaft 282 into rotation operation of the movable blade part 261.

Next, the operation of the reinforcing bar binding machine 1F in which the reinforcing bar S is bound by the two wires W will be described. The wire W is sandwiched between the first feeding gear 230L of the reinforcing bar binding machine 1F and the second feeding gear 230R thereof.

When the reinforcing bar S is placed between the first guide 250 of the curl guide 205 and the second guide 251 thereof, and the operation trigger 212 is operated, the feeding motor 233 rotates in the forward direction, after which the first feeding gear 230L is driven by the feeding motor 233 and rotates in the forward direction. When the first feeding gear 230L rotates, the second feeding gear 230R rotates following the first feeding gear 230L in the forward direction. Accordingly, the two wires W that are sandwiched between the first feeding gear 230L and the second feeding gear 230R are fed in the forward direction.

When the wire W is fed in the forward direction, the wire W passes through the curl guide 205, such that the curling tendency is provided around the periphery of the reinforcing bar S. The wire W having the curling tendency provided by the first guide 250 is guided to the gripping part 270 by the second guide 251. When an end part of the wire W is fed to a predetermined position, driving of the feeding motor 233 is stopped. Accordingly, the wire W is wound around the reinforcing bar S in a loop shape.

After stopping the feeding of the wire W, the twisting motor 280 rotates in the forward direction, such that the gripping part 270 is operated by the operation part 271 and the end part of the wire W is gripped. When the wire W is gripped by the gripping part 270, the rotation of the twisting motor 280 is temporarily stopped and the feeding motor 233 is rotated in a reverse direction. When the feeding motor 233 rotates in the reverse direction, the first feeding gear 230L rotates in the reverse direction, and the second feeding gear 230R rotates following the first feeding gear 230L in the reverse direction. Accordingly, the wire W sandwiched between the first feeding gear 230L and the second feeding gear 230R is fed in the reverse direction. According to the operation of feeding the wire W in the reverse direction, the wire W comes into close contact with the reinforcing bar S and is wound therearound.

After winding the wire W around the reinforcing bar S and stopping the reverse rotation of the feeding motor 233, the twisting motor 280 is operated to rotate in the forward direction, such that the movable blade part 261 is operated by the moving member 283 via the transmission mechanism 262, thereby cutting the wire W.

After cutting the wire W, the twisting motor 280 is operated to continuously rotate in the forward direction, such that the end part of the wire W is bent toward a side of the reinforcing bar S by a bent part (not shown) of the operation part 271, and further the twisting motor 280 is operated to continuously rotate in the forward direction, such that the gripping part 270 gripping the wire W is integrally rotated with the operation part 271, thereby twisting the wire W.

After twisting the wire W, the twisting motor 280 is operated to rotate in the reverse direction, such that the gripping part 270 is operated by the operation part 271 and the gripping of the wire W is released.

Further, in the embodiment, the reinforcing bar S is bound by two wires, but the reinforcing bar S may be bound by one wire.

Hereinafter, details of the bridge part 303 such as a configuration thereof, a size thereof, material thereof, and the like; details of a size of the reinforcing bar binding machine 1F that is provided with the bridge part 303; and action effect of providing the bridge part 303 thereto will be described.

Here, in FIGS. 14, 15, 16, and 17, a direction that is orthogonal to the direction shown by the arrow A11 and in the extending direction of the handle part 211 is referred to as a first direction, and the first direction is shown by an arrow Al2. Further, a direction that is orthogonal to the direction shown by the arrow A11 and orthogonal to the first direction is referred to as a second direction, and the second direction is shown by an arrow A13.

Additionally, when a length in the extending direction of the bridge part 303 is longer than lengths in the first direction and the second direction, the extending direction of the bridge part 303 is referred to as a long-length direction of the bridge part 303, the first direction is referred to as a first short-length direction of the bridge part 303, and the second direction is referred to as a second short-length direction of the bridge part 303.

As described above, in the reinforcing bar binding machine 1F, the first main body 301 and the second main body 302 are connected to each other by the bridge part 303, such that a distance between the binding part 201 and the handle part 211 extends more than a reinforcing bar binding machine of the related art that is not provided with the bridge part 303.

Accordingly, when binding the reinforcing bar S existing at a worker's feet, the worker can perform binding operation in a standing posture without significantly bending the waist and the knees. Accordingly, it is advantageously possible for the worker to perform the binding operation while walking and moving without repeatedly bending the knee and the waist significantly and standing, thereby improving workability.

Figure 23:
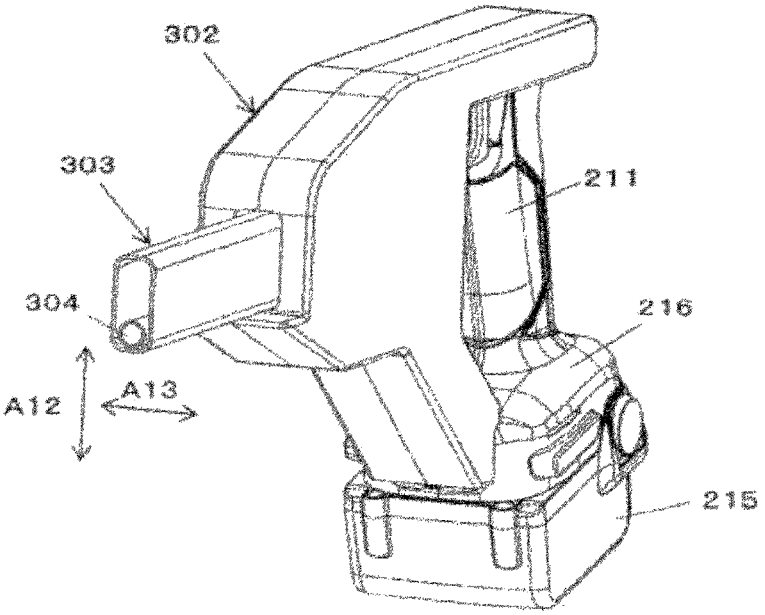
FIG. 23 is a perspective view illustrating a cross-sectional shape of a bridge part.

FIG. 23 is a perspective view illustrating a cross-sectional shape of a bridge part. The bridge part 303 is formed such that a cross-sectional area of a cross section of the bridge part 303 (refer to FIG. 23) in the first short-length direction (the first direction) shown by the arrow A12 and the second short-length direction (the second direction) shown by the arrow A13 is smaller than cross-sectional areas of the first main body 301 and the second main body 302 in the same direction.

Accordingly, the size of the bridge part 303 is formed to be thinner than those of the first main body 301 and the second main body 302, and may be formed to be equal to or less than that of the handle part 211. Since the bridge part 303 can be formed to be thin and thus can be easily gripped, the bridge part 303 provides the following advantageous effects. When the reinforcing bar S to be bound exists at the worker's feet, it does not cause a big matter. However, for example, in a case where the worker intends to bind the reinforcing bar S existing in front of the worker or above the worker, since the whole length of the reinforcing bar binding machine 1F is long and is provided with the heavy object at the tip side thereof, a burden exerted on the worker's hand (worker's hand for gripping the handle part 211) is large. However, in the reinforcing bar binding machine 1F provided with the bride part 11, the worker can grip the bridge part 303 with the other hand, that is, the hand that does not grip the handle part 211, thereby reducing the burden exerted on the worker's hand and thus consequently improving the workability. As another advantageous effect, when carrying the reinforcing bar binding machine 1F, the worker can grip the bridge part 303 while carrying the reinforcing bar binding machine 1F, thereby improving portability.

As shown in FIG. 15, in the bridge part 303, a length L303SL in the first short-length direction (first direction) shown by the arrow A12 is set to be equal to or shorter than a length L301SL in the same direction of the first main body 301. Further, as shown in FIG. 16, a length L303SS in the second short-length direction (second direction) shown by the arrow A13 is set to be equal to or shorter than ½ (one half) of a length of L301SS in the same direction of the first main body 301. The length L30355 is desirably set to be equal to or shorter than ⅓(one third) of the length of L301SS.

When the length L303SL of the bridge part 303 is longer than the length L301SL of the first main body 301 or the length L303SS of the bridge part 303 is longer than ½(one half) of the length L301SS of the first main body 301, an area around the first main body 301, that is, a target object and surroundings thereof may be blocked by the bridge part 303, thereby interfering with the work and causing deterioration of the workability, when performing the binding operation. In consideration of the aforementioned drawback, the length L303SL of the bridge part 303 is set to be equal to or shorter than the length L301SL of the first main body 301, and the length L303SS of the bridge part 303 is set to be equal to or shorter than ½ (one half) of the length L301SS of the first main body 301, thereby not only improving visibility of the target object and the surroundings thereof, but also improving the workability.

As shown in FIG. 14, the reinforcing bar binding machine 1F has a length in the direction shown by the arrow A11. A length L301L1 between the other end of the driving part 202, in the embodiment, a rear end part of the twisting motor 280 which is an end part opposite to a side to which the rotating shaft 282 is connected in the twisting motor 280, and the operation trigger 212 is set to be approximately 0.5 to 0.8 times, desirably 0.6 to 0.7 times longer than a length L301L2 between the contact part 207 of the first main body 301 and the operation trigger 212 in the same direction.

Usually, the length L301L2 between the contact part 207 and the operation trigger 212 is set to be from about 600 to about 850 mm, such that the worker can perform the binding operation in the standing posture without significantly bending the waist and the knees. Since the length from the contact part 207 of the first main body 301 to the end part of the twisting motor 280 is set to be from about 150 mm to about 300 mm, the length L301L1 from the rear end part of the twisting motor 280 including the bridge part 303 to the operation trigger 212 is set to be from about 300 mm to about 700 mm. That is, the length L301L1 is set to be approximately 0.5 to 0.8 times longer than the L301L2. According to the aforementioned configuration of the lengths L301L1 and L301L2, it is advantageously possible to design the reinforcing bar binding machine 1F having a desirable size for the worker who performs the binding operation in the standing posture. Further, an area ratio occupied by the bridge part 303 with respect to the whole reinforcing bar binding machine 1F is formed to be as large as possible, thereby not only reducing the weight of the whole reinforcing bar binding machine 1F, but also improving the weight balance thereof.

The bridge part 303 has a shape linearly extending, and a virtual center line in an extending direction of the bridge part 303 is referred to as an axis Axb of the bridge part 303. In the reinforcing bar binding machine 1F, the bridge part 303 is mounted on the first main body 301, such that an axis Ax of the binding part 201 and an axis Axb of the bridge part 303 coincide with each other or approximately coincide with each other.

Further, the bridge part 303 is mounted on the second main body 302, such that a lower end part TU of the operation trigger 212 at the other side in the extending direction of the handle part 211 is disposed on the axis Ax of the binding part 201. Here, when the lower end part TU of the operation trigger 212 is disposed on the axis Ax of the binding part 201, the lower end part TU of the operation trigger 212 and the axis Ax of the binding part 201 coincide with each other. Meanwhile, as shown in FIG. 14, the lower end part TU of the operation trigger 212 may be deviated by a predetermined amount in an up-and-down direction (upward direction in FIG. 14) with respect to the axis Ax of the binding part 201.

The lower end part TU of the operation trigger 212 is disposed on the axis Ax, such that the middle finger of the hand of the worker gripping the handle part 211 is almost disposed on the axis Ax. When the middle finger is disposed on the axis Ax, the weight balance of the reinforcing bar binding machine 1F at the time of operation can be improved, thereby having an effect of easily aligning a position with respect to the reinforcing bar S, and improving the operability.

The second main body 302 is provided with a mounting part 290 on which the bridge part 303 is mounted, such that the bridge part 303 is mounted on the mounting part 290 by a screw 291. The first main body 301 has the same configuration as that of the second main body 302, and the bridge part 303 is a separate body from the first main body 301 and the second main body 302.

Accordingly, the bridge part 303 is replaceable. Since the bridge part 303 is replaceable, it is advantageously possible to replace the bridge part 303 with another bridge part having a different size and material depending on a working environment. Further, since the reinforcing bar binding machine 1F having an extending shape is divided into the first main body 301, the second main body 302, and the bridge part 303, a casing is smaller in comparison with work, where parts are assembled to a casing in which the first main body, the second main body, and the bridge part are integrated, thereby having an effect of improving assemblability.

As described above, since material of the bridge part 303 is different from material of the first main body 301 and the second main body 302, the bridge part 303 can be formed of a separate member from the first main body 301 and the second main body 302. The bridge part 303 is formed of, for example, metallic elements such as aluminum and stainless steel, and the like, and nonmetallic elements such as a resin material and a carbon fiber, and the like, thereby having an effect of reducing a weight. The casings of the first main body 301 and the second main body 302 are made of a normal resin, and when the bridge part 303 is made of a resin material, a different resin material may be used for the first main body 301 and the second main body 302. Further, it may be possible to use the resin material and the metallic element by covering the periphery of the metallic element with the resin material.

As described above, the bridge part 303 is formed of a light element, thereby reducing the weight and thus improving the operability.

As shown in a cross-sectional view in FIG. 23, the bridge part 303 has a hollow structure. When the bridge part 303 is the metallic elements such as the aluminum, and the like, the bridge part 303 may be formed of a tubular member, a whole body of which is hollow in the extending direction. When the bridge part 303 is the resin material, a plurality of ribs may be provided to secure strength. Further, in the reinforcing bar binding machine 1F, an electric signal and a power source may be supplied between the first main body 301 and the second main body 303. Therefore, the bridge part 303 may be provided with a cable housing part 304. The cable housing part 304 may be provided with a tubular member through which a wiring passes in the extending direction of the bridge part 303, or may be provided with a groove through which the wiring passes.

Accordingly, since the bridge part 303 is hollow and the cable housing part 304 is provided without providing a mechanism such as a link, the weight of the reinforcing bar binding machine 1F having a shape extending from the bridge part 303 is prevented from increasing, thereby having an effect of reducing the weight and thus improving the operability. Additionally, the bridge part 303 may be formed of a plurality of tubular members. In this case, one of the plurality of bridge parts may be bent into a predetermined shape, such that the connection part 218 of the first main body 301 and the connection part 217 of the second main body 302 may be formed as the bridge part.

Figure 24:
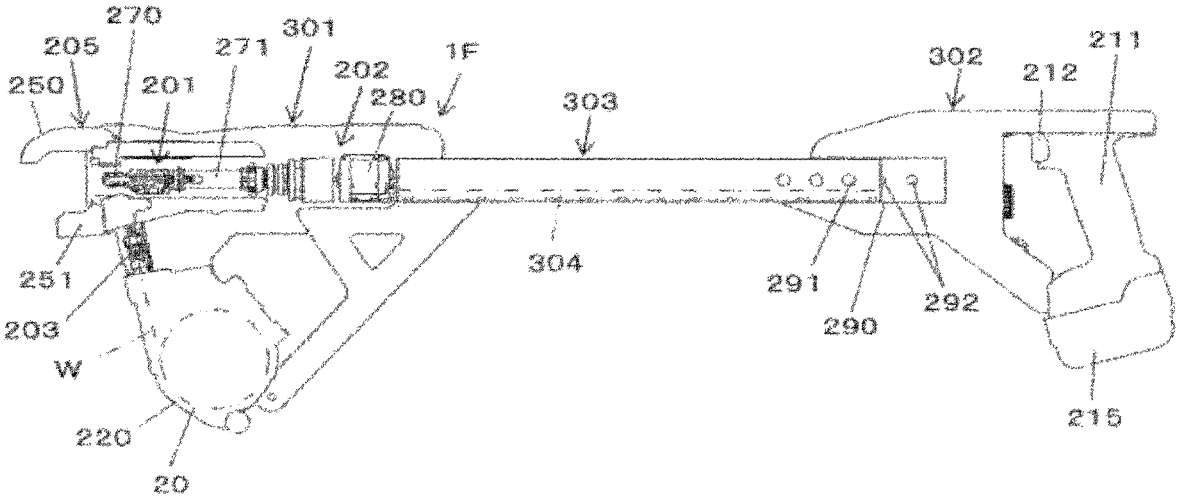
FIG. 24 is a side-view illustrating an example of a configuration in which an extending length is variable by a bridge part.

FIG. 24 is a side-view illustrating an example of a configuration in which an extending length is variable by a bridge part. The second main body 302 is provided with the mounting part 290 of the bridge part 303, and the bridge part 303 is mounted by the screw 291. The mounting part 290 is provided with a plurality of screw holes 292 in the extending direction of the bridge part 303, such that it is advantageously possible to switch a position for fixing the bridge part 303 with respect to the second main body 302 in the extending direction of the bridge part 303.

Accordingly, since the fixing position of the bridge part 303 with respect to the second main body 302 is switched, a length between the first main body 301 and the second main body 302 is formed to be variable. A length in an extending direction of the reinforcing bar binding machine 1F by the bridge part 303 can be set to a desirable length depending on the worker who performs the binding operation in the standing posture.

Further, since the bridge part 303 is formed to be detachable between the first main body 301 and the second main body 302, the bridge part 303 provided with a desirable length can be selected among the bridge parts 303 having different lengths, after which the selected bridge part 303 can be mounted on the first main body 301 and the second main body 302.

Accordingly, the length in the extending direction of the reinforcing bar binding machine 1F by the bridge part 303 can be desirably set depending on the worker who performs the binding operation in the standing posture.

The reinforcing bar binding machine 1F is provided with the magazine 220 as the housing part in which the reel 20 of the first main body 301 is housed, and the magazine 220 is provided at a lower side of the binding part 201 in the feeding direction of the wire W. Accordingly, it is advantageously possible to shorten a distance between the magazine 220 and the binding part 201, thereby improving reliability of wire W feeding.

The reinforcing bar binding machine 1F is provided with the wire feeding part 203 in the first main body 301. The wire feeding part 203 is provided between the binding part 201 and the magazine 220. Accordingly, consumption of the wire W can be reduced when performing operation in which the wire W is fed in the reverse direction and wound around the reinforcing bar S.

Figure 25:
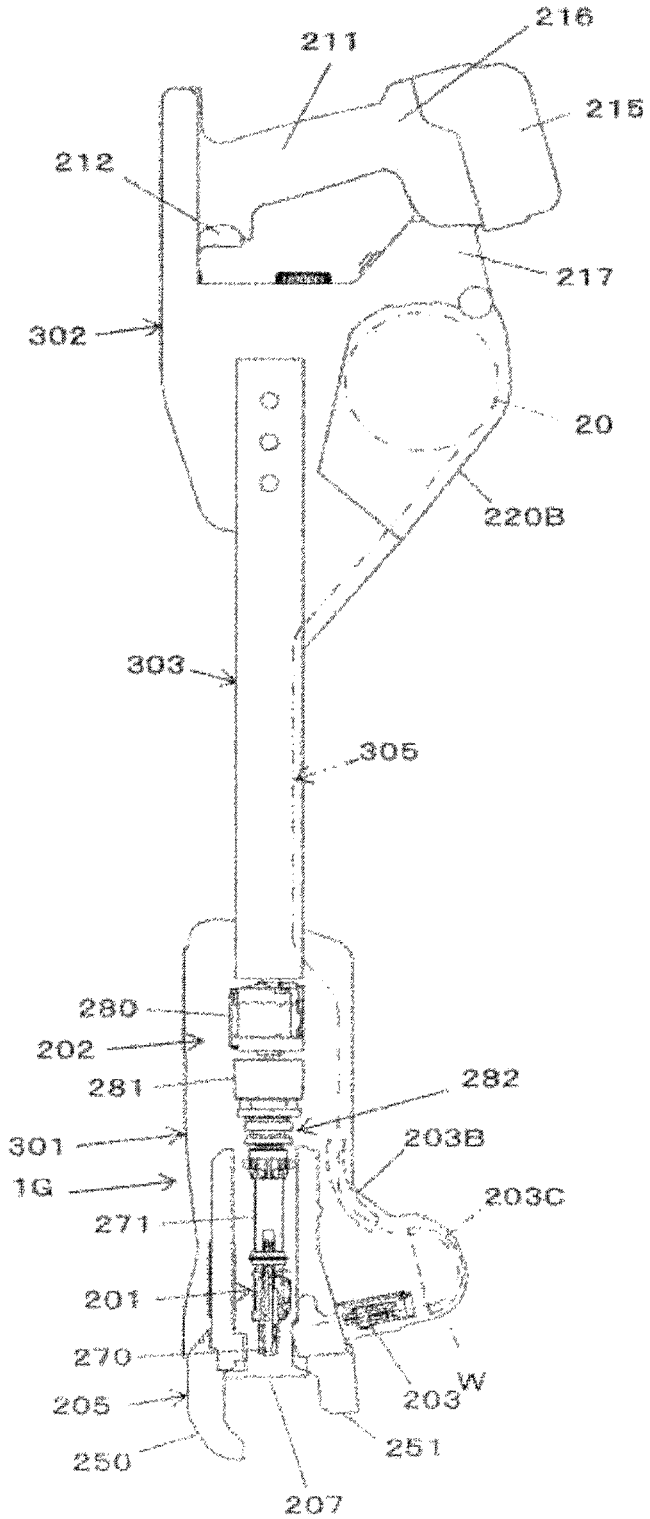
FIG. 25 is a side-view illustrating a variation of the reinforcing bar binding machine according to the sixth embodiment.

FIG. 25 is a side-view illustrating a variation of the reinforcing bar binding machine according to the sixth embodiment. In a variation of the sixth embodiment, a reinforcing bar binding machine 1G is provided with the first main body 301 in which the binding part 201 for twisting the wire W and the driving part 202 for driving the binding part 201, and the like; the second main body 302 provided with the handle part 211 including the operation trigger 212; and the bridge part 303 which connects the first main body 301 and the second main body 302 to each other.

In the reinforcing bar binding machine 1G, as described above, the first main body 301 and the second main body 302 are connected to each other by the bridge part 303, such that a distance between the binding part 201 and the handle part 211 extends more than a reinforcing bar binding machine of the related art that is not provided with the bridge part 303.

In the first main body, the binding part 201 is provided at one side of the first main body 301 with respect to a direction in which the reinforcing bar binding machine 1G is extended by the bridge part 303. Further, the bridge part 303 is connected to the other side of the first main body 301 with respect to the direction in which the reinforcing bar binding machine 1G is extended by the bridge part 303.

In the second main body 302, the bridge part 303 is connected to one side of the second main body 302 with respect to the direction in which the reinforcing bar binding machine 1G is extended by the bridge part 303. Further, the second main body 302 is provided with the handle part 211 on the other side with respect to the direction in which the reinforcing bar binding machine 1G is extended by the bridge part 303.

The handle part 211 extends in a direction that is almost orthogonal and is not parallel to the direction in which the reinforcing bar binding machine 1G is extended by the bridge part 303. The operation trigger 212 is provided at the upper end part of the handle part 211 which is one side in the extending direction of the handle part 211.

In the reinforcing bar binding machine 1G, the second main body 302 is provided with a magazine 220B which is an housing part in which the wire is housed. The magazine 220B rotatably and detachably houses the reel 20 around which the wire is wound to be fed.

Further, in the reinforcing bar binding machine 1G, the first main body 301 is provided with the feeding part 203 which feeds the wire W to the binding part 201. Further, a second feeding part 203B which feeds the wire W to the wire feeding part 203 is provided at an upstream side of the wire feeding part 203 of the first main body 301, with respect to the feeding direction of the wire W fed in the forward direction. Additionally, the reinforcing bar binding machine 1G is provided with an housing space 203C that is capable of bending the wire W by feeding the wire W in the reverse direction in the first main body 301 between the wire feeding part 203 and the second wire feeding part 203B.

Further, the reinforcing bar binding machine 1G is provided with a guide passage 305 through which the wire W passes between the first main body 301 and the second main body 302 in the bridge part 303.

As described above, the magazine 220B in which the wire is housed is provided in the second main body 302, such that it is advantageously possible not only to reduce the weight of the first main body 301, but also to improve the operability.

What is claimed is:

1. A binding machine, comprising;

a housing part that is configured to house a wire reel around which a wire is wound;

a feeding part that is configured to feed the wire housed in the housing part;

a feeding motor that is configured to drive the feeding part;

a guide part that is configured to curl the wire fed by the feeding part;

a twisting part that is configured to twist the wire curled by the guide part:

a twisting motor that is configured to drive the twisting part;

a binding machine main body that houses the feeding part, the feeding motor and the twisting motor and that is provided with the housing part;

a transmission part that connects the twisting motor with the twisting part and that is configured to transmit driving force of the twisting motor to the twisting part;

a guiding path that is configured to guide the wire fed by the feeding part to the guide part; and a long connection part that is provided between the binding machine main body and the guide part and that houses the transmission part and the guiding path, wherein the long connection part has:

in a long-length direction, a first length which is equal to or longer than one third of a length of the binding machine main body in the long-length direction;

in a short-length direction, a second length which is equal to or shorter than a length of the binding machine main body in the short-length direction; and in a direction orthogonal to the long-length and short-length directions, a third length which is equal to or shorter than one half of a length of the binding machine main body in the direction orthogonal to the long-length and short-length directions, the long connection part includes which extends in the long-length direction and which is at least partly formed to be flat and formed with a retracting part which has a concave shape provided between the binding machine main body and the guide part, the concave shape reducing the length of the long connection part in the short-length direction.

2. The binding machine according to claim 1, wherein the guide part is provided at one end of the binding machine main body, in the long-length direction, the binding machine main body is provided with a handle part between a first position at a side of the one end and a second position at a side of the other end opposite to the one end of the binding machine main body in the long-length direction, and a length between the second position of the binding machine main body and a virtual line orthogonal to the long-length direction at the other end of the binding machine main body is equal to or longer than one half of a length of the handle part in the long-length direction, the other end being positioned at the opposite side of the one end of the binding machine main body.

3. The binding machine according to claim 1, wherein the length of the long connection part in the long-length direction is equal to or longer than one half of the length of the binding machine main body in the long-length direction.

4. The binding machine according to claim 1, wherein the long connection part has a rectangular shape in a cross-sectional view in the short-length direction.

5. The binding machine according to claim 1, wherein the long connection part has an ellipse shape in a cross-sectional view which length in the short-length direction is longer than a length in the direction orthogonal to the long-length and short-length directions.

6. The binding machine according to claim 1, wherein the long connection part is provided with a support part which is detachably mounted on the retracting part and at which the exterior part is flat.

7. The binding machine according to claim 1, wherein the long connection part is provided with a support part which is mounted so as to close and open the retracting part and at which the exterior part is flat.

8. The binding machine according to claim 1, wherein the long connection part is integrally formed with the binding machine main body.

9. The binding machine according to claim 2, wherein the housing part is configured to support the wire reel such that a part of or an entire wire reel is positioned to protrude toward a direction of the other end of the binding machine main body from an axis of the handle part in an extending direction of the handle part.

10. The binding machine according to claim 2, wherein a part of or an entire twisting motor is positioned to protrude toward the direction of the other end of the binding machine main body from an axis of the handle part in an extending direction of the handle part.

* * * * *